US008186800B2

(12) United States Patent
Sugahara

(10) Patent No.: US 8,186,800 B2
(45) Date of Patent: May 29, 2012

(54) PRINTER SYSTEM, MAIN PRINTER TO BE USED THEREFOR, AND METHOD FOR DISCHARGING WASTE INK

(75) Inventor: Hiroto Sugahara, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1108 days.

(21) Appl. No.: 12/049,518

(22) Filed: Mar. 17, 2008

(65) Prior Publication Data

US 2008/0231677 A1 Sep. 25, 2008

(30) Foreign Application Priority Data

Mar. 19, 2007 (JP) ..... 2007-071195

(51) Int. Cl.
*B41J 29/393* (2006.01)

(52) U.S. Cl. ..... 347/19

(58) Field of Classification Search ..... 347/85, 347/86, 19

See application file for complete search history.

(56) References Cited

U.S. PATENT DOCUMENTS

| | | | |
|---|---|---|---|
| 4,608,575 | A | 8/1986 | Morgan |
| 6,742,887 | B2 | 6/2004 | Ando |

FOREIGN PATENT DOCUMENTS

| | | | |
|---|---|---|---|
| EP | 0578334 | A2 | 2/1989 |
| JP | H10-24613 | A | 1/1998 |
| JP | 2003072107 | A | 3/2003 |

OTHER PUBLICATIONS

European Patent Office; European Search Report in Application No. 08004785.5-1251 / 1972451 (counterpart to the above-captioned U.S. patent application) mailed Apr. 24, 2009.

*Primary Examiner* — Lamson Nguyen
(74) *Attorney, Agent, or Firm* — Baker Botts L.L.P.

(57) ABSTRACT

A printer system includes a main printer having a first head and a waste ink tank for accommodating any waste ink; and a portable type sub printer having a second head which is detachable with respect to the main printer. The waste ink tank accommodates the waste ink discharged from the second head of the sub printer installed to the main printer. Accordingly, the printer system is provided, wherein it is unnecessary to provide any waste ink tank in the portable type sub printer, an ink tank of the sub printer can be allowed to have a large volume, and it is unnecessary to provide any exclusive station for processing any waste ink of the sub printer.

25 Claims, 16 Drawing Sheets

PRINTER SYSTEM, MAIN PRINTER TO BE USED THEREFOR, AND METHOD FOR DISCHARGING WASTE INK

CROSS REFERENCE TO RELATED APPLICATION

The present application claims priority from Japanese Patent Application No. 2007-071195, filed on Mar. 19, 2007, the disclosure of which is incorporated herein by reference in its entirety.

BACKGROUND OF THE INVENTION

1. Field of the Invention

The present invention relates to a printer system provided with a main printer which includes a first tank having a large volume and a first discharge head and a sub printer which includes a second tank having a volume smaller than that of the first tank and a second discharge head, the main printer to be used for the printer system, and a method for discharging the waste ink.

2. Description of the Related Art

A portable type printer has been suggested, which is small in size as compared with a stationary type printer provided with a paper feed/discharge mechanism and which can be carried about, for example, with one hand (see, for example, Japanese Patent Application Laid-open Nos. 10-24613 and 2003-72107). Even in the case of such a portable type printer, it is necessary that any bubble, which exists in the ink stored in the ink tank, should be removed and/or the meniscus, which is formed in the nozzle hole of the discharge head, should be adjusted in order to appropriately form the image on the recording member. For this purpose, it is required to appropriately perform the purge process.

However, when the purge process is performed, the ink is discharged from the discharge head. Therefore, it is necessary to provide a waste ink-accommodating section for accommodating the discharged waste ink. If the waste ink-accommodating section is provided in a narrow and small casing of the portable type printer, it is necessary that the ink tank, which is accommodated in the casing as well, should have a smaller volume. This contravenes such an object aimed for the portable type printer that it is intended to increase the volume of the ink tank in order to avoid any early ink shortage. In view of the above, Japanese Patent Application Laid-open Nos. 10-24613 and 2003-72107 describe a portable type printer which is not provided with any discharge ink-accommodating section for the purge operation, wherein a discharge ink-accommodating section is provided for an exclusive station which is subjected to the docking with the portable type printer.

However, the exclusive station as described above finds no way of use except when the portable type printer is subjected to the docking. Further, the installation space is not small as well. In this viewpoint, it is not affirmed that the exclusive station as described above is convenient for the user.

SUMMARY OF THE INVENTION

In view of the above, an object of the present invention is to provide a printer system which makes it possible to realize a large volume or capacity of an ink tank without providing any waste ink-accommodating section in a portable type printer and which requires no provision of any exclusive station.

Another object of the present invention is to provide a main printer to be used for the printer system, and a method for discharging a waste ink.

The present invention has been made taking the foregoing circumstances into consideration. According to a first aspect of the present invention, there is provided which performs printing by discharging an ink onto a recording medium, the printer system including:

- a main printer having a first head which discharges the ink onto the recording medium and a waste-ink tank which stores a waste ink; and
- a portable type sub printer having a second head which discharges the ink onto the recording medium, the sub printer being detachable with respect to the main printer, and the waste-ink tank accommodates the waste ink discharged from the second head of the sub printer when the sub printer is installed to the main printer.

According to the first aspect of the present invention, when the sub printer (slave printer) is installed to the main printer (master printer), the waste ink, which is discharged from the second head of the sub printer as a result of the purge or the like, can be accommodated in the waste ink tank provided in the main printer. Therefore, it is unnecessary to prepare any exclusive station which is to be used only for performing the waste ink treatment or processing in the sub printer. The sub printer can be miniaturized, or the space in the casing thereof can be effectively utilized in order to realize the large volume or capacity of the ink tank, because it is unnecessary to provide any waste ink tank in the sub printer. Further, the main printer as described above has the first head, and it is provided with the printer function. Therefore, the main printer can be used not only for the waste ink treatment for the sub printer but also as the ordinary printer. The main printer is equivalent to the stationary type printer which is widely used, for example, in homes, and such a stationary type printer may be substituted with the main printer. Therefore, when the main printer is installed in the space in which the stationary type printer has been originally installed, any excessive installation space is not required, which is convenient.

In the printer system of the present invention, the waste ink tank may also store a waste ink discharged from the first head of the main printer. When the printer system is constructed as described above, one waste ink tank can be used for accommodating both of the waste ink discharged from the first head and the waste ink discharged from the second head. Therefore, it is possible to realize a low price of the printer system, and it is possible to realize the space saving.

In the printer system of the present invention, the main printer may further include a pump by which the waste ink is discharged from the second head when the sub printer is installed to the main printer. When the printer system is constructed as described above, it is unnecessary for the sub printer to provide any pump for discharging the waste ink from the second head. Therefore, the sub printer can be further miniaturized, or the space in the casing thereof can be utilized more effectively in order to realize the large volume or capacity of the ink tank.

In the printer system of the present invention, the waste ink from the first head of the main printer is also discharged by the pump. When the printer system is constructed as described above, one pump can be used as both of the pump for discharging the waste ink from the first head and the pump for discharging the waste ink from the second head. Therefore, it is possible to realize a low price of the printer system, and it is possible to realize the space saving.

In the printer system of the present invention, the printer system may further include a controller which controls the main printer and the sub printer, and the controller may allow the second head of the sub printer to discharge the waste ink when the sub printer is installed to the main printer. When the printer system is constructed as described above, the waste ink can be discharged from the second head of the sub printer by only installing the sub printer to the main printer without performing any other operation, which is convenient.

In the printer system of the present invention, the printer system may further include a controller which controls the main printer and the sub printer and an input device which inputs a predetermined instruction into the controller, and the controller may allow the second head of the sub printer to discharge the waste ink when the sub printer is installed to the main printer and the predetermined instruction is inputted into the input device. When the printer system is constructed as described above, the waste ink can be discharged from the second head of the sub printer in accordance with the timing determined by a user.

In the printer system of the present invention, the main printer may further include an installing section to which the sub printer is detachably installed, a cap for the second head which hermetically seals an ink-discharge surface of the second head, through which the ink is discharged, when the sub printer is installed to the installing section, and a communication passage which makes communication between the cap for the second head and the waste ink tank. When the printer system is constructed as described above, the ink-discharge surface of the sub printer is hermetically sealed by the cap, when the sub printer is installed to the installing section of the main printer. Therefore, the waste ink, which is discharged from the ink discharge surface, can be introduced into the waste ink-accommodating section via the communication passage by sucking the air contained in the cap by the pump.

In the printer system of the present invention, the main printer may include a cap for the first head which hermetically seals an ink-discharge surface of the first head, through which the ink is discharged, and a communication passage which makes communication between the cap for the first head and the waste ink tank. When the printer system is constructed as described above, the ink-discharge surface of the first head is hermetically sealed by the cap. Therefore, the waste ink, which is discharged from the ink discharge surface, can be introduced into the waste ink-accommodating section via the communication passage by sucking the air contained in the cap by means of the pump.

In the printer system of the present invention, the printer system may further include a controller which controls the main printer and the sub printer, and the main printer may have a first tank which stores the ink, and the sub printer has a second tank which stores the ink and which has a volume smaller than that of the first tank; and the first tank may communicate with the second tank so as to supply the ink from the first tank to the second tank when the sub printer is installed to the main printer. When the printer system is constructed as described above, in addition to the treatment of the waste ink as described above, the second tank having the small volume, which is possessed by the sub printer, can be also supplemented with the ink from the first tank having the large volume which is possessed by the main printer, by installing the sub printer to the main printer. There is such a possibility that the ink may leak from the second head communicated with the second tank when the ink is supplied to the second tank of the sub printer. However, the leaked ink can be accommodated in the waste ink tank.

In the printer system of the present invention, the controller may be operated such that the waste ink is discharged from the second head of the sub printer after supplying the ink from the first tank to the second tank. When the printer system is constructed as described above, the ink is supplied to the second tank of the sub printer, while any bubble, which tends to be mixed especially upon the ink supply, can be removed, and the meniscus can be adjusted in the nozzle hole on the ink discharge surface of the second discharge head. That is, when the ink is supplied from the first tank of the main printer to the second tank of the sub printer, then the bubble is mixed into the communication passage when the both are communicated with each other, and the bubble makes invasion into the second tank of the sub printer in accordance with the ink supply in some cases. However, the bubble can be removed. As described above, there is such a possibility that the ink may leak from the nozzle hole of the second head as the ink is supplied to the second tank. During this process, the meniscus of the nozzle hole is destroyed in some cases. However, the meniscus can be adjusted again by discharging the waste ink after supplying the ink to the second tank.

In the printer system of the present invention, the main printer may include a first regulating section which regulates a flow of the ink between the first tank and the first head; and the controller may allow the waste ink to be discharged from the second head of the sub printer in a state in which the flow of the ink is regulated by the first regulating section between the first tank and the first head. When the printer system is constructed as described above, it is possible to avoid the flow of the ink from the first tank of the main printer to the first head when the waste ink is discharged from the second head in the state in which the sub printer is installed to the main printer.

In the printer system of the present invention, the main printer may include a second regulating section which regulates a flow of the ink between the first tank and the second tank; and the controller may allow the ink to be supplied from the first tank to the first head in a state in which the flow of the ink is regulated by the second regulating section between the first tank and the second tank. When the printer system is constructed as described above, it is possible to avoid the supply of the ink from the first tank of the main printer to the second tank of the sub printer when the ink is supplied from the first tank of the main printer to the first head in the state in which the sub printer is installed to the main printer.

In the printer system of the present invention, the main printer may further include a detecting mechanism which detects that the sub printer is installed to the main printer. In this arrangement, the information about whether or not the sub printer is installed to the main printer can be always retained. The information can be utilized, for example, as the trigger information for the method for processing the waste ink.

According to a second aspect of the present invention, there is provided a main printer which performs printing by discharging an ink onto a recording medium, the main printer including:

- a first head which discharges the ink onto the recording medium;
- a sub printer-installing section to which a sub printer having a second head which discharges the ink onto the recording medium is detachably installed; and
- a waste ink tank which stores a waste ink discharged from the second head when the sub printer is installed to the main printer.

According to the second aspect of the present invention, it is unnecessary to prepare any exclusive station for treating the waste ink discharged from the sub printer as described above.

It is possible to miniaturize the sub printer, and it is possible to realize the large volume or capacity of the ink tank (second tank) carried in the sub printer.

In the main printer of the present invention, the waste ink tank may also store a waste ink discharged from the first head. When the main printer is constructed as described above, the waste ink tank can be used for the both as described above. Therefore, it is possible to realize a low price of the main printer, and it is possible to realize the space saving.

In the main printer of the present invention, the main printer may further include a pump by which the waste ink is discharged from the second head when the sub printer is installed to the main printer. When the main printer is constructed as described above, it is unnecessary for the sub printer to provide the pump as described above. Therefore, it is possible to further miniaturize the sub printer, and it is possible to realize the large volume of the ink tank.

In the main printer of the present invention, the waste ink from the first head of the main printer may be also discharged by the pump. When the main printer is constructed as described above, the pump can be used for the both as described above. Therefore, it is possible to realize a low price of the main printer, and it is possible to realize the space saving.

In the main printer of the present invention, the main printer may further include a controller which controls the main printer and the sub printer, a first tank which stores the ink, and a first regulating section which regulates a flow of the ink between the first tank and the first head; and the controller may allow the waste ink to be discharged from the second head of the sub printer in a state in which the flow of the ink is regulated by the first regulating section between the first tank and the first head. When the main printer is constructed as described above, in addition to the treatment of the waste ink of the sub printer as described above, the second tank can be also supplemented with the ink. Further, the ink, which leaks from the second head during the ink supply, can be accommodated in the waste ink tank.

In the main printer of the present invention, the main printer may further include a second regulating section which regulates flow of the ink between the first tank and a second tank possessed by the sub printer, and the controller may allow the ink to be supplied from the first tank to the first head in a state in which the flow of the ink is regulated by the second regulating section between the first tank and the second tank. When the main printer is constructed as described above, the ink can be supplied to the second tank of the sub printer as described above, while any bubble contained in the second tank can be removed. Further, it is possible to adjust the meniscus in the nozzle hole on the ink discharge surface of the second discharge head.

According to a third aspect of the present invention, there is provided a method for discharging a waste ink from a printer system; the printer system including a main printer having a first head which discharges an ink onto a recording medium, a first tank which stores the ink, a first valve which regulates a flow of the ink between the first tank and the first head, and a waste ink tank which stores the waste ink; and a portable type sub printer having a second head which discharges the ink onto the recording medium, and a second valve which regulates a flow of the ink between the first tank and the second tank, the sub printer being detachable with respect to the main printer; wherein the waste ink tank stores the waste ink discharged from the second head of the sub printer installed to the main printer; and the method including detecting installation of the sub printer;

closing the first valve and opening the second valve when the installation of the sub printer is detected; and discharging the waste ink from the second head.

The method for discharging the waste ink of the present invention may further include supplying the ink from the first tank to the second tank before discharging the waste ink from the second head.

According to a fourth aspect of the present invention, there is provided a method for discharging a waste ink from a printer system, the printer system including:

a main printer having a first head which discharges an ink onto a recording medium, a first tank which stores the ink, a first valve which regulates a flow of the ink between the first tank and the first head, and a waste ink tank which stores the waste ink; a portable type sub printer having a second head which discharges the ink onto a recording medium, and a second valve which regulates a flow of the ink between the first tank and the second tank, the sub printer being detachable with respect to the main printer; and an input device which inputs a predetermined instruction, wherein the waste ink tank stores the waste ink discharged from the second head of the sub printer installed to the main printer, and the method comprising:

detecting installation of the sub printer;

closing the first valve and opening the second valve when the installation of the sub printer is detected and the predetermined instruction is inputted from the input device; and discharging the waste ink from the second head.

According to the printer system, the main printer, and the sub printer concerning the present invention, it is possible to allow the ink tank to have the large volume without providing any waste ink tank in the portable type printer, while it is unnecessary to provide any exclusive station.

DESCRIPTION OF THE PREFERRED EMBODIMENTS

An explanation will be specifically made below with reference to the drawings about a printer system according to an embodiment of the present invention and a main printer and a sub printer for constructing the printer system.

Figure 1:
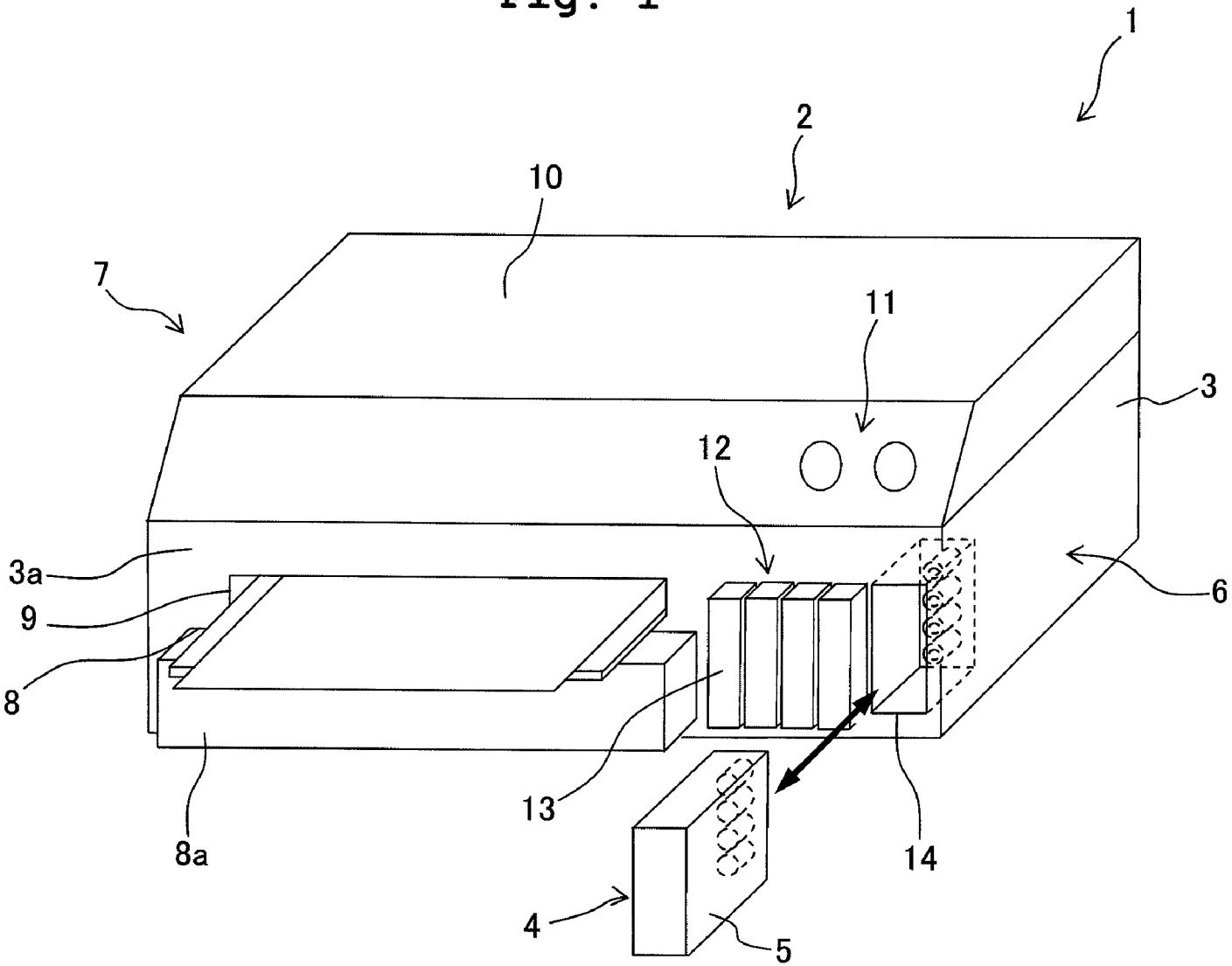
FIG. 1 schematically shows a perspective view illustrating a structural appearance of a printer system according to an embodiment of the present invention.

FIG. 1 schematically shows a perspective view illustrating a structural appearance of a printer system 1 according to an embodiment of the present invention. As shown in FIG. 1, the printer system 1 comprises a main printer (master printer or server printer) 2 of the stationary type which has a substantially rectangular parallelepiped-shaped casing 3, and a portable type sub printer (slave printer or client printer) 4 which is detachably installed to the main printer 2 and which has a casing 5 that is relatively smaller than the casing 3.

In this embodiment, the main printer 2 is a multifunction apparatus. The main printer 2 has a printer section 6 which is provided at a lower portion of the casing 3 and which has a first discharge head (see FIG. 4) for recording the image by means of the ink-jet system. The main printer 2 has a scanner section 7 which is provided at an upper portion of the casing 3 and which has an image sensor (not shown) to read the image of a manuscript. A paper feed port 8 is formed at a lower portion of a front wall 3*a* of the casing 3. A paper feed tray 8*a*, which accommodates the recording paper (recording member or recording medium), is installed thereto. In this arrangement, a plurality of sheets of the recording paper, which have the A4 size at the maximum, can be accommodated in the paper feed tray 8*a*.

A paper discharge port 9 is formed over the paper feed port 8 of the front wall 3*a*. The recording paper, on which the image is formed by the printer section 6, is discharged from the paper discharge port 9. The scanner section 7 is a so-called flat bed scanner. The scanner section 7 has a manuscript stand (not shown) which is formed on the upper surface of the casing 3, and a manuscript cover 10 which is provided openably/closably to cover the manuscript stand. An operation panel 11, which is used to operate the printer section 6 and the scanner section 7, is provided in front of the manuscript cover 10.

A tank-installing section 12, to which first ink tanks (ink cartridges) 13 are detachably installed, is provided on the front wall 3*a* of the casing 3 at a side portion with respect to the paper feed port 8 and the paper discharge port 9. The first ink tank 13 has a large volume or capacity (for example, 10 cc), which stores the ink to be discharged to the recording paper when the image is formed by the printer section 6. When the residual amount of the ink in the first ink tank 13 is not more than a predetermined value as the ink is discharged onto the recording paper, then the first ink tank 13 is detached from the tank-installing section 12, and a new first ink tank 13, which is fully filled with the ink, can be installed. In this embodiment, those used as the inks employed to form the image include four color inks, i.e., cyan (C), magenta (M), and yellow (Y) as the dye inks and black (Bk) as the pigment ink. Therefore, the four first ink tanks 13 in total, which correspond to the respective colors, are detachably installed to the tank-installing section 12.

A sub printer installing port 14, to which the sub printer 4 is installed, is provided on the front wall 3*a* of the casing 3 at a side portion with respect to the tank-installing section 12. As described above, both of the tank-installing section 12 and the sub printer installing port 14 are provided on the identical wall surface (front wall 3*a*) of the casing 3. Therefore, the degree of freedom is increased for the installation of the main printer 2 as compared with a case in which the both are provided on distinct wall surfaces, which is convenient for the user.

Figure 2:
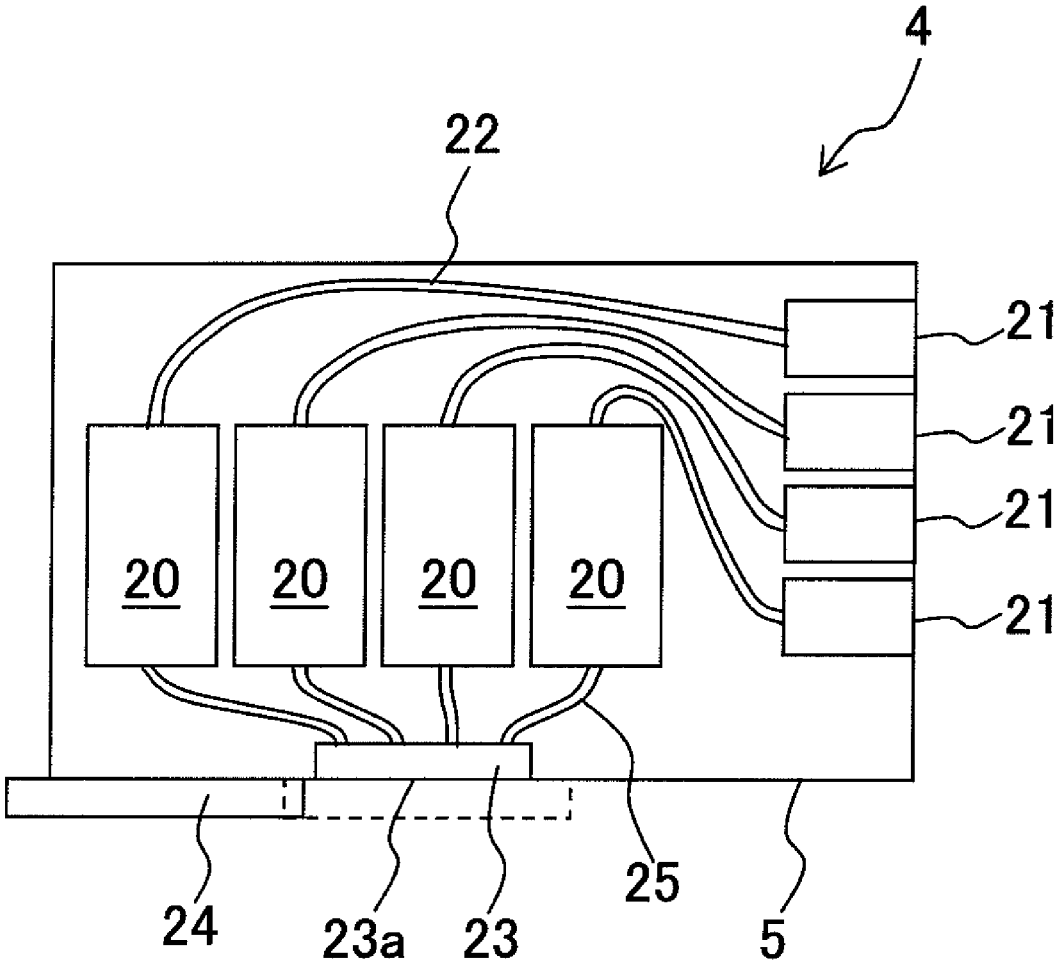
FIG. 2 schematically shows a side view illustrating an arrangement of a sub printer, which depicts an internal structure by removing one side surface of a casing thereof.
Figure 3:
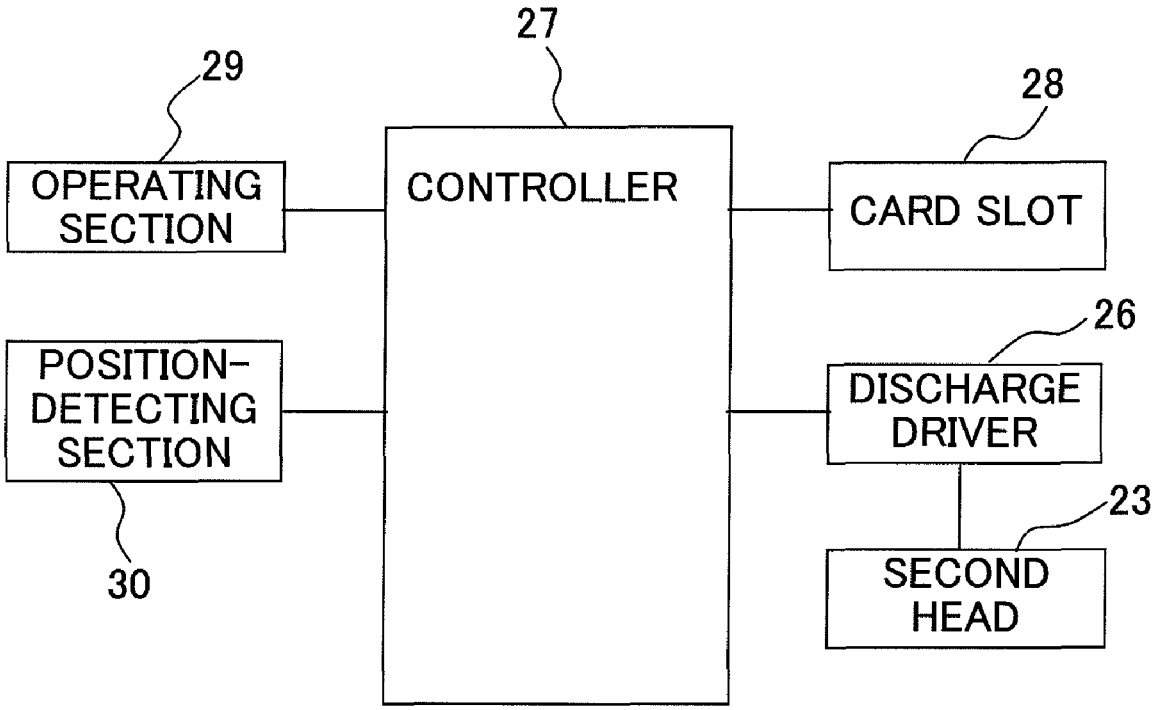
FIG. 3 shows a block diagram illustrating the function of the sub printer shown in FIG. 2.

FIG. 2 schematically shows a side view illustrating an arrangement of the sub printer 4, which depicts an internal structure as viewed when one side surface of the casing 5 is removed. FIG. 3 shows a block diagram illustrating the function of the sub printer 4 shown in FIG. 2. As shown in FIG. 2, the sub printer 4 has the rectangular parallelepiped-shaped casing 5 and four second ink tanks 20 each having a small volume (for example, 1 cc) provided in the casing 5. The second ink tanks 20 correspond to the four color inks described above. Four subsidiary-side connecting sections 21, which make communication between the second ink tanks 20 and the first ink tanks 12 installed to the main printer 2, are provided on one side wall of the casing 5. The subsidiary-side connecting sections 21 correspond to the four second ink tanks 20. The subsidiary-side connecting sections 21 are connected to the second ink tanks 20 one to one via tubes 22.

A second discharge head 23 (see FIG. 3) having a nozzle surface 23*a*, and a head cover 24 to openably/closably cover the nozzle surface 23*a* of the second discharge head 23 are provided on another side wall of the casing 5. The nozzle surface 23*a* is provided so that the nozzle surface 23*a* is exposed to the outside of the second discharge head 23. When the head cover 24 is closed (as shown by broken lines in FIG. 2), the nozzle surface 23*a* is covered with the head cover 24 substantially hermetically. When the head cover 24 is opened (as shown by solid lines in FIG. 2), the nozzle surface 23*a* is exposed to the outside of the second discharge head 23. The second ink tanks 20 of the respective colors are connected to the second discharge head 23 via tubes 25. The inks, which are supplied from the second ink tanks 20, are discharged to the outside.

As shown in FIG. 3, the sub printer 4 includes a discharge driver 26 for driving the second discharge head 23. The discharge driver 26 is connected to a controller 27. The controller 27 is composed of, for example, an IC chip, RAM, and ROM, and is operable in accordance with a program recorded in ROM. The sub printer 4 is provided with a card slot 28 which is connected to the controller 27, an operating section 29, and a position-detecting section 30. Various types of small-sized memory cards as storage media can be installed to the card slot 28. For example, the image data, which is stored in the small-sized memory card installed to the card slot 28, can be read by performing the predetermined operation with the operating section 29. The read image data is once stored in RAM possessed by the controller 27. The second discharge head 23 discharges the inks in accordance with the instruction supplied from the controller 27, and thus the image represented by the image data can be formed on the recording medium.

The sub printer 4 is provided with a roller or rollers (not shown) for maintaining a constant distance from the recording paper, for example, when the manual scanning is performed on the recording paper. The position-detecting section 30 is capable of detecting the position of the sub printer 4 in accordance with the angle of rotation of the roller. The controller 27 controls the ink discharge from the second discharge head 23 on the basis of the information in relation to the position inputted from the position-detecting section 30.

The sub printer 4 can perform the purge process to discharge the waste inks from the second discharge head 23 in a state of being installed to the main printer 2. Further, the inks can be supplied from the first ink tanks 12 installed to the main printer 2 to the second ink tanks 20 of the sub printer 4. An explanation will be made below in respective embodiments about forms of connection brought about when the sub printer 4 is installed to the main printer 2.

First Embodiment

Figure 4:
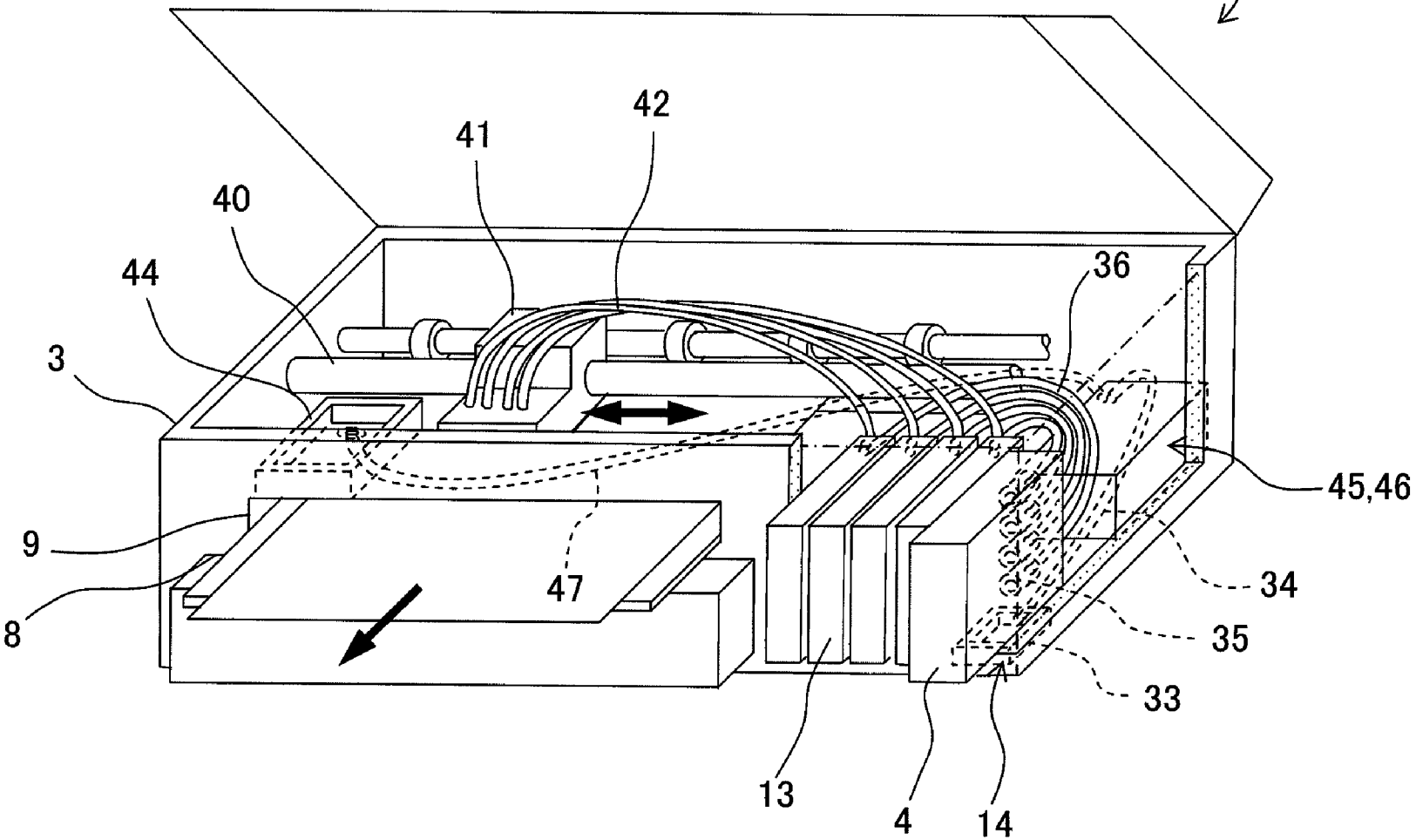
FIG. 4 schematically shows a perspective view illustrating an internal arrangement of a main printer to which the sub printer is installed.
Figure 5:
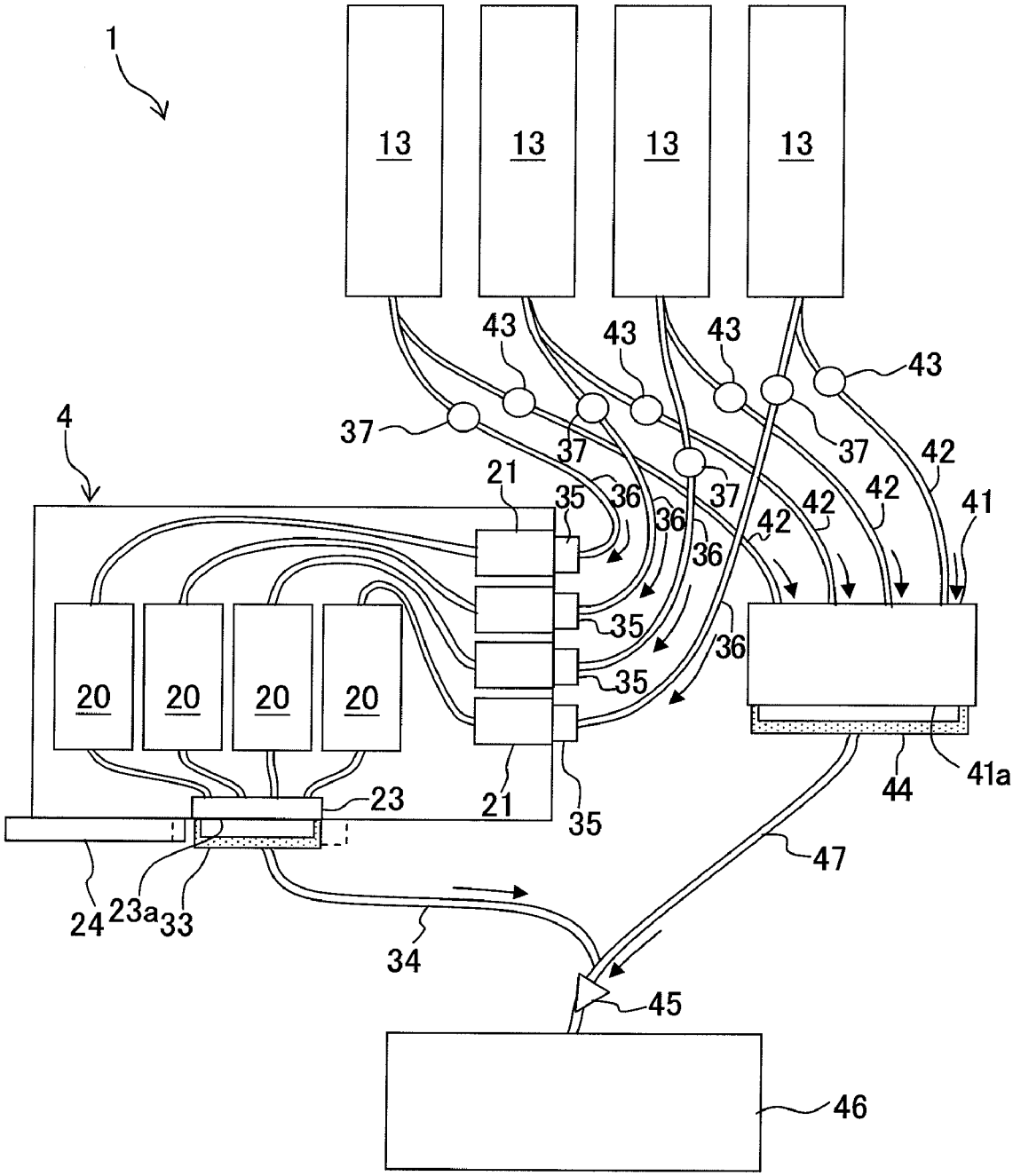
FIG. 5 schematically shows a printer system, which depicts a form of connection according to a first embodiment when the sub printer is installed to the main printer.

FIG. 4 schematically shows a perspective view illustrating an internal arrangement of the main printer 2 to which the sub printer 4 as described above is installed. FIG. 5 schematically shows the printer system 1, which depicts a form of connection according to a first embodiment when the sub printer 4 is installed to the main printer 2.

As shown in FIG. 4, a guide rod 40, which extends in the left-right direction, is provided in the casing 3 of the main printer 2. A first discharge head 41 (see FIG. 5 as well) is supported by the guide rod 40 so that the first discharge head 41 is capable of being subjected to the scanning in the left-right direction. Four tubes 42, which correspond to the respective colors of the inks, are provided to extend from the first discharge head 41. The tubes 42 are connected to the tank-installing section 12 respectively. As shown in FIG. 5, first valves (first regulating sections) 43, which regulate the flow of the inks, are provided for the respective tubes 42. The respective first valves 43 are operable independently from each other.

Therefore, when the first ink tanks 13 are installed to the tank-installing section 12, the first ink tanks 13 and the first discharge head 41 are communicated with each other via the tubes 42 in a state in which the first valves 43 are opened. Therefore, the inks of the respective colors can be independently supplied from the first ink tanks 13 to the first discharge head 41. On the other hand, the inks are not allowed to flow via the tubes 42 between the first ink tanks 13 and the first discharge head 41 in a state in which the first valves 43 are closed, because the closing is effected between the first ink tanks 13 and the first discharge head 41.

As shown in FIG. 4, a first cap (cap for the first discharge head) 44, which hermetically seals the nozzle surface 41*a* of the first discharge head 41 (see FIG. 5) from the lower portion, is provided in the casing 3 of the main printer 2. The first cap 44 is provided at the position at which the first cap 44 is opposed to the nozzle surface (ink discharge surface) 41*a* when the first discharge head 41 is positioned at one end in the scanning range. In FIG. 4, the first cap 44 is provided oppositely to the left end of the scanning range of the first discharge head 41. A pump 45 and a waste ink-accommodating section 46 are provided at the back of the tank-installing section 12 at the right end in the casing 3. The waste ink-accommodating section 46 has an unillustrated case and an ink-absorbing member such as sponge accommodated in the case. As shown in FIG. 5, the waste ink-accommodating section 46 is communicated with the first cap 44 via a tube (communication passage) 47. The pump 45 is capable of sucking the fluid via the tube 47.

As shown in FIG. 4, a second cap 33 is arranged in the vicinity of the lower portion of the sub printer installing port 14 in the casing 3. The second cap 33 hermetically seals the nozzle surface (ink discharge surface) 23*a* of the second discharge head 23 of the sub printer 4 from the lower position when the sub printer 4 is installed to the sub printer installing port 14. As shown in FIG. 5 as well, the second cap 33 is connected to the waste ink-accommodating section 46 via a tube (communication passage) 34. The fluid, which is contained in the tube 34, is also sucked by the pump 45 described above.

Main-side connecting sections 35 are provided in the sub printer installing port 14 in the main printer 2. When the sub printer 4 is installed to the sub printer installing port 14, the main-side connecting sections 35 are connected to the subsidiary-side connecting sections 21 (see FIG. 5). Tubes 36 are allowed to extend from the main-side connecting sections 35. Forward ends of the tubes 36 are connected to the first ink tanks 13 installed to the tank-installing section 12. Second valves (second regulating sections) 37, which regulate the flow of the inks in the tubes 36, are provided at intermediate positions of the tubes 36 which are allowed to extend from the main-side connecting sections 35 to the first ink tanks 13. The respective second valves 37 are operable independently from each other.

Figure 6:
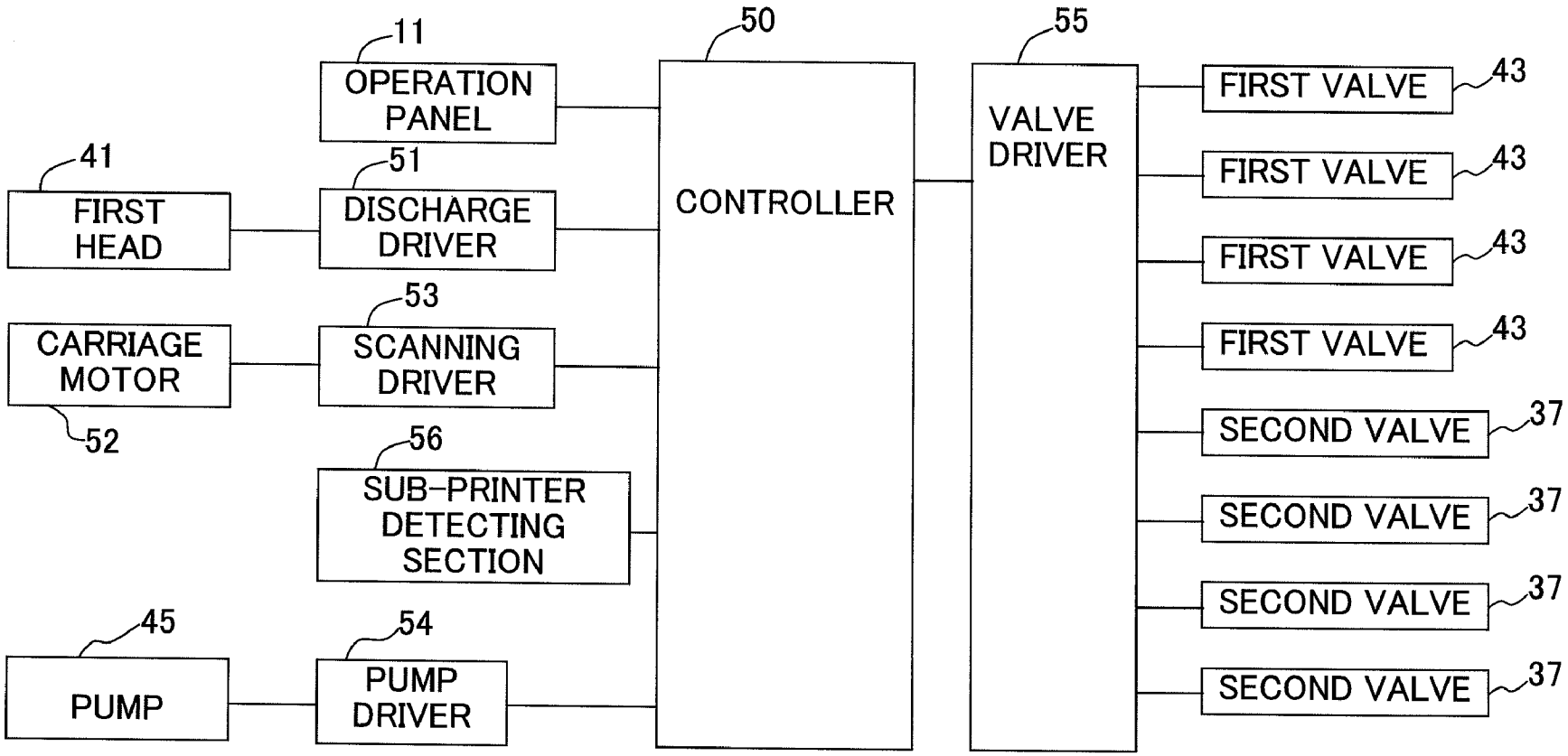
FIG. 6 shows a block diagram illustrating the function of the main printer.

FIG. 6 shows a block diagram illustrating the function of the main printer 2 described above. As shown in FIG. 6, the main printer 2 is provided with a controller 50. The operation panel 11 is connected to the controller 50. Further, the first discharge head 41 is connected to the controller 50 via a discharge driver 51. The main printer 2 further comprises a carriage motor 52 which moves the first discharge head 41 in the scanning direction, and a scanning driver 53 which drives the carriage motor 52. The carriage motor 52 is connected to the controller 50 via the scanning driver 53. Therefore, when the user operates the operation panel 11, the controller 50 outputs control signals to the discharge driver 51 and the scanning driver 53 respectively. The scanning driver 53 moves the first discharge head 41 by a predetermined distance in the scanning direction on the basis of the control signal. The discharge driver 51 operates the discharge head 41 on the basis of the control signal to discharge the inks.

The pump 45 described above is connected to the controller 50 via a pump driver 54. Further, the valves 37, 43 are connected to the controller 50 via a valve driver 55. The pump driver 54 and the valve driver 55 output driving signals on the basis of control signals supplied from the controller 50 to drive the pump 45 and the valves 37, 43 in accordance with the driving signals.

Further, a sub printer detecting section 56 is connected to the controller 50. The sub printer detecting section 56 detects whether or not the sub printer 4 is connected to the main printer 2, in particular whether or not the sub printer 4 is installed to the sub printer installing port 14 to connect the subsidiary-side connecting sections 21 with respect to the main-side connecting sections 35. The information thereof is outputted to the controller 50.

Figure 7:
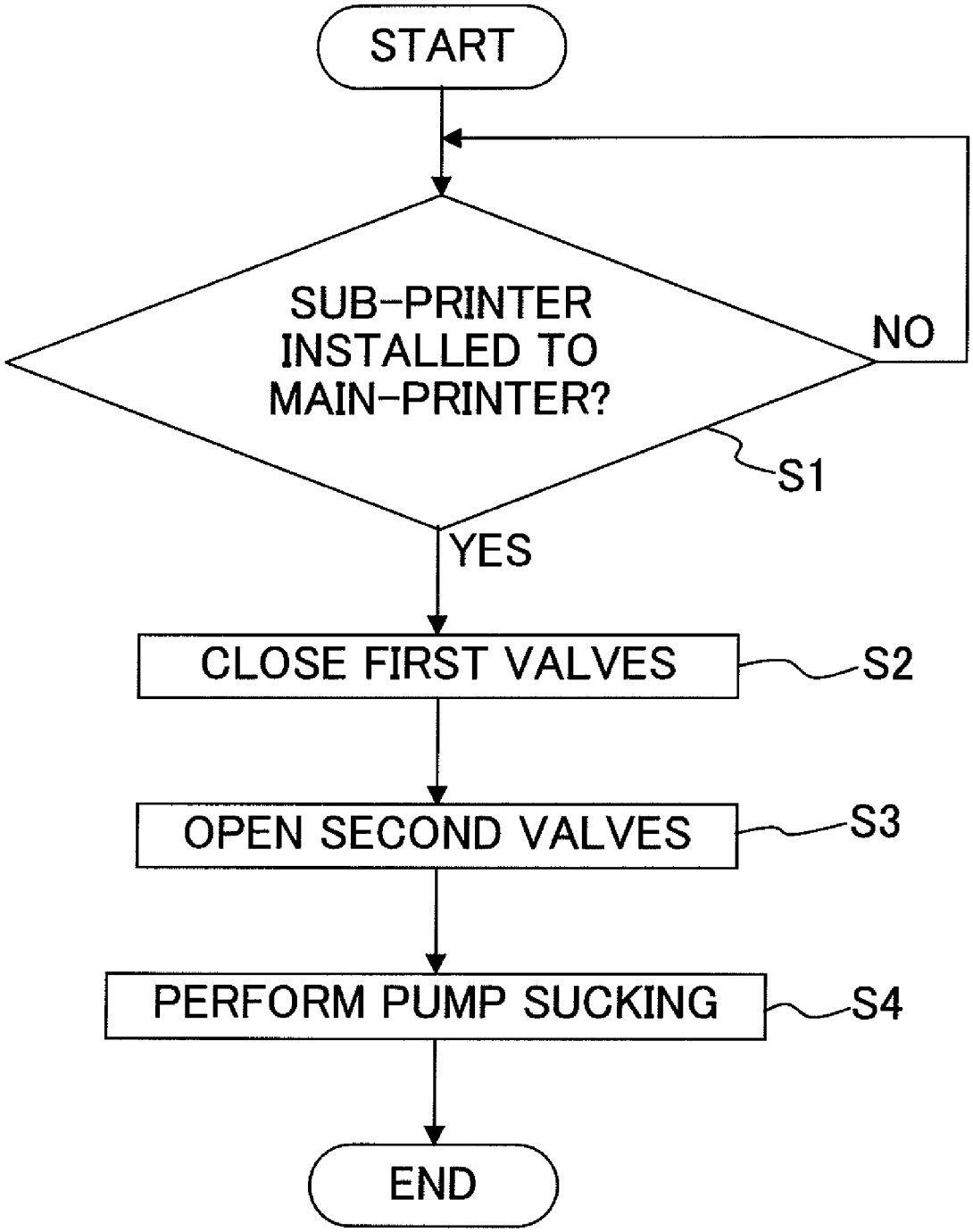
FIG. 7 shows a flow chart illustrating the operation of the main printer when the purge process is performed for the sub printer by using a trigger of the installation of the sub printer in the printer system.

Next, an explanation will be made with reference to flow charts shown in FIGS. 7 to 9 about the purge process for the sub printer 4 in the printer system 1 comprising the main printer 2 and the sub printer 4 as described above. FIG. 7 shows a flow chart illustrating the operation of the main printer 2 when the purge process is performed for the sub printer 4 by using a trigger of the installation of the sub printer 4 to the main printer 2 in the printer system 1.

As shown in FIG. 7, the controller 50 of the main printer 2 judges whether or not the sub printer 4 is installed to the main printer 2 on the basis of the signal supplied from the sub printer detecting section 56 (S1). If it is judged that the sub printer 4 is not installed (S1: NO), the operation of Step 1 is repeated. If it is judged that the sub printer 4 is installed (S1: YES), the routine proceeds to the next step. When the sub printer 4 is installed to the main printer 2 as shown in FIG. 5, the both are connected to one another by the aid of the main-side connecting sections 35 and the subsidiary-side connecting sections 21. The head cover 24 of the sub printer 4 is opened, and the nozzle surface 23*a* of the exposed second discharge head 23 is hermetically sealed by the second cap 33.

If it is judged by the controller 50 in Step 1 that the sub printer 4 is installed to the main printer 2, then the controller 50 regulates the ink flow between the first ink tanks 13 and the first discharge head 41 by closing the first valves 43 (S2), and the second valves 37 are opened (S3). Accordingly, the passages, which range from the first ink tanks 13 of the main printer 2 via the sub printer 4 and the second cap 33 to arrive at the waste ink-accommodating section 46, are in the communicated state. Subsequently, when the pump 45 is driven to effect the sucking (S4), the purge process is performed, in which the waste inks are forcibly discharged from the nozzle holes (not shown) of the second discharge head 23 of the sub printer 4. The waste inks, which are discharged from the second discharge head 23 by means of the purge process, are accommodated in the waste ink-accommodating section 46 provided for the main printer 2. The inks do not flow from the first ink tanks 13 to the first discharge head 41 during the purge process for the sub printer 4, because the first valves 43 are closed.

When the sub printer 4 is installed to the main printer 2, any bubble is mixed between the main-side connecting sections 35 and the subsidiary-side connecting sections 21 in some cases. The bubble cannot be discharged to the outside in the state in which the sub printer 4 is installed to the main printer 2. As described later on with reference to FIG. 9, when the inks are supplied from the first ink tanks 13 to the second ink tanks 20, there is such a possibility that the bubble may be mixed in (make invasion into) the second discharge head 23 from the second ink tank 20. However, any bubble, which exists in the flow passages in the second discharge head 23, can be discharged together with the waste ink by performing the purge process as described above. Further, it is also possible to adjust the meniscus.

When the printer system 1 is operated as described above, it is unnecessary for the user to worry about the timing at which the purge process is to be performed for the sub printer 4. The purge process can be automatically executed by merely installing the sub printer 4 to the main printer 2 when the sub printer 4 is not used.

Figure 8:
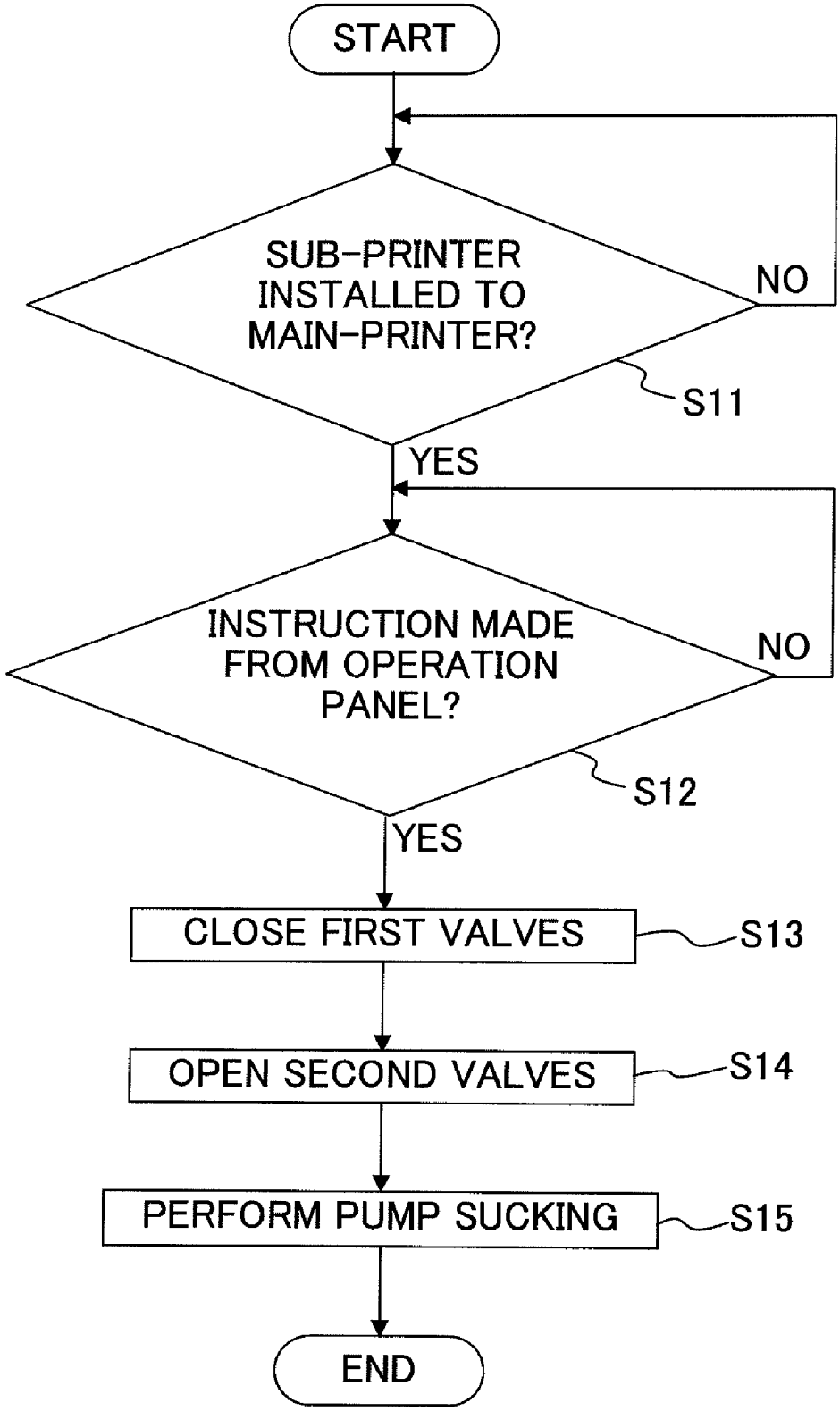
FIG. 8 shows a flow chart illustrating the operation of the main printer when the purge process is performed for the sub printer on the basis of the operation of an operation panel by a user after installing the sub printer in the printer system.

FIG. 8 shows a flow chart illustrating the operation of the main printer 2 when the purge process is performed for the sub printer 4 on the basis of the operation of the operation panel 11 by the user after installing the sub printer 4 in the printer system 1. As shown in FIG. 8, the controller 50 of the main printer 2 judges whether or not the sub printer 4 is installed to the main printer 2 on the basis of the signal supplied from the sub printer detecting section 56 (S11). If it is judged by the controller 50 that the sub printer 4 is not installed (S11: NO), the operation of Step 11 is repeated. If it is judged that the sub printer 4 is installed (S11: YES), it is subsequently judged whether or not the operation panel 11 is operated by the user to output, from the operation panel 11, the purge instruction signal to instruct the purge process (S12).

If it is judged by the controller 50 that the purge instruction signal is not outputted from the operation panel 11 (S12: NO), the operation of Step 12 is repeated. If it is judged that the purge instruction signal is outputted (S12: YES), the purge process is executed in the same manner as in Steps 2 to 4 having been explained with reference to FIG. 7 such that the first valves 43 are closed (S13), the second valves 37 are opened (S14), and the pump 45 is finally driven to effect the sucking so that the waste inks are forcibly sucked from the second discharge head 23. Accordingly, the bubble contained in the second discharge head 23 can be discharged, and the meniscus can be adjusted in the same manner as the case shown in FIG. 7. The waste inks discharged from the second discharge head 23 are accommodated in the waste ink-accommodating section 46 with which the main printer 2 is provided.

When the printer system 1 is operated as described above, the purge process can be performed for the sub printer 4 at the timing determined by the user. Therefore, for example, even when the sub printer 4 is installed to the main printer 2 during the period in which the image is formed on the recording paper by discharging the inks from the first discharge head 41 by means of the main printer 2, then the image-forming operation performed by the main printer 2 is not interrupted, and the purge process is not executed for the sub printer 4. After the completion of the image formation by the main printer 2, the user can perform the purge process for the sub printer 4 at the desired timing.

Figure 9:
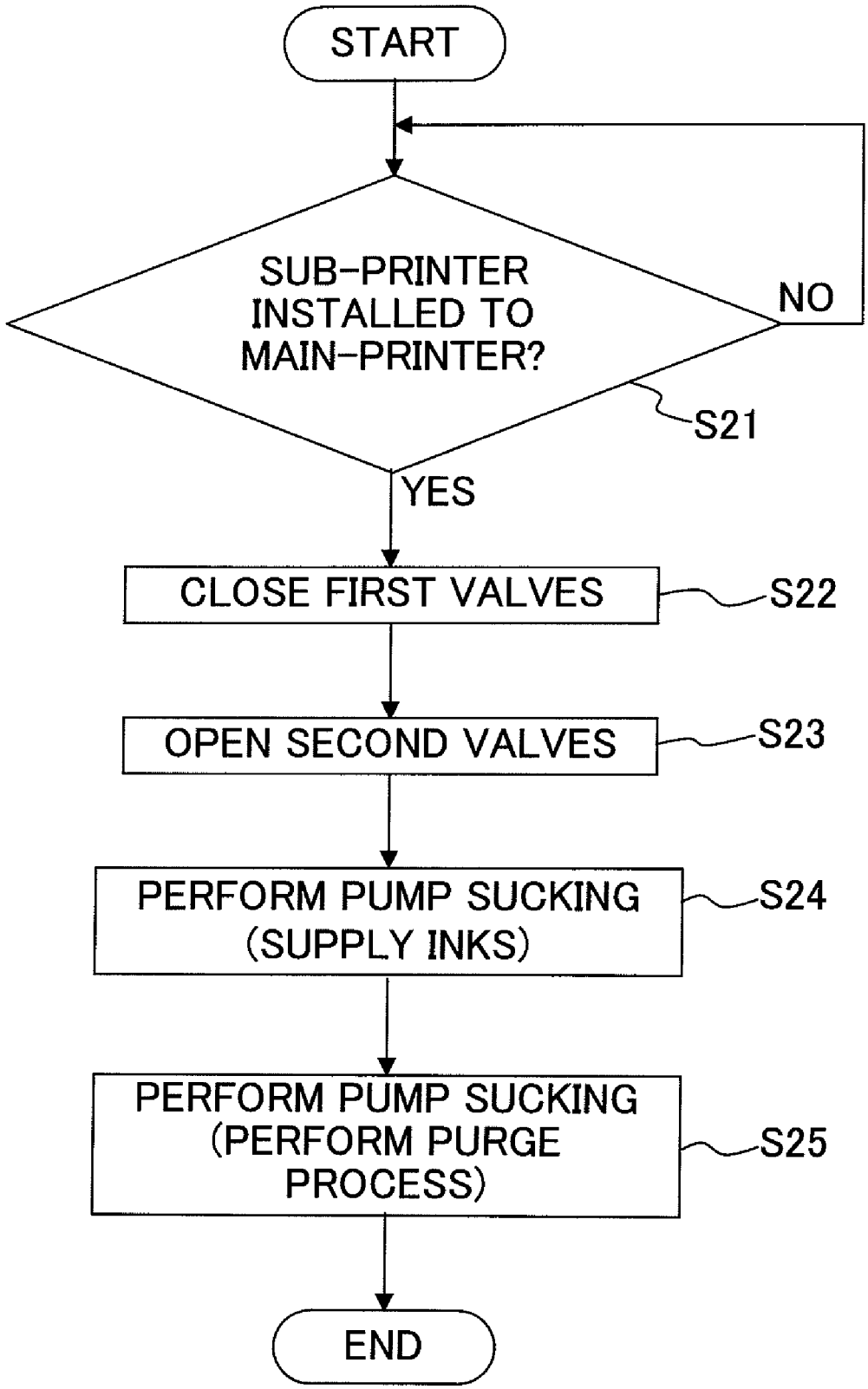
FIG. 9 shows a flow chart illustrating the operation of the main printer when the purge process is performed after supplying inks to second ink tanks after installing the sub printer in the printer system.

FIG. 9 shows a flow chart illustrating the operation of the main printer 2 when the purge process is performed after firstly supplying the inks to the second ink tanks 20 after installing the sub printer 4 in the printer system 1. As shown in FIG. 9, the controller 50 of the main printer 2 judges whether or not the sub printer 4 is installed to the main printer 2 on the basis of the signal supplied from the sub printer detecting section 56 (S21). If it is judged by the controller 50 that the sub printer 4 is not installed (S21: NO), the operation of Step 21 is repeated. If it is judged that the sub printer 4 is installed (S21: YES), the first valves 43 are closed (S22), and the second valves 37 are opened (S23) in the same manner as in Steps 2 and 3 shown in FIG. 7.

Subsequently, the controller 50 drives the pump 45 to effect the sucking so that the inks are supplied to the second ink tanks 20 (S24). That is, the first ink tanks 13 of the main printer 2 and the second ink tanks 20 of the sub printer 4 are communicated with each other at the point of time at which Step 23 is completed. Therefore, the inks contained in the first ink tanks 13 can be supplied to the second ink tanks 20 by driving the pump 45. When the ink supply is completed, the controller 50 executes the purge process by driving the pump 45 to effect the sucking so that the waste inks are forcibly sucked from the second discharge head 23 (S25). Accordingly, as having been explained above, any bubble, which enters the flow passage in the second discharge head 23, can be discharged to the outside together with the waste inks. The waste inks are accommodated in the waste ink-accommodating section 46 provided for the main printer 2. The meniscus of the second discharge head 23 can be also adjusted by means of the purge process in the same manner as the process shown in FIG. 7.

The driving mode of the pump 45, which is adopted in order to supply the ink as shown in Step 24 in FIG. 9, may be different from the driving mode of the pump 45 which is adopted in order to perform the purge as shown in Step 25.

That is, in order to discharge the bubble contained in the second discharge head 23 by means of the purge process, it is necessary that the pump 45 should be driven at a speed not less than a predetermined speed to suck the inks at a pressure not less than a predetermined pressure. Therefore, the setting may be made such that the driving speed (sucking pressure) of the pump 45 for the purpose of the purge is larger than the driving speed (sucking pressure) for the purpose of the ink supply.

As explained above with reference to FIGS. 7 to 9, in the printer system 1 according to the embodiment of the present invention, the purge process is performed for the sub printer 4 during which the sub printer 4 is installed to the main printer 2. The waste inks, which are discharged from the sub printer 4 by means of the purge process, are accommodated in the waste ink-accommodating section 46 provided for the main printer 2. The main printer 2 has the first ink tanks 13, and the image can be formed on the recording paper by driving the first discharge head 41. As described above, the main printer 2 is also provided with the function to treat the waste inks of the sub printer 4 in addition to the ordinary printer function.

As shown in FIG. 5, the main printer 2 carries the waste ink-accommodating section 46 and the pump 45 which are used for the purge process for the sub printer 4. Therefore, the space in the casing 5 of the sub printer 4 can be effectively utilized in order to realize the large volumes of the second ink tanks 20.

The pump 45, which is provided for the main printer 2, can be also used as the pump to purge the first discharge head 41. Further, the pump 45 can be also used as the pump to purge the second discharge head 23 of the sub printer 4 in the state in which the sub printer 4 is installed to the main printer 2. In this way, in the printer system 1 according to the first embodiment, the single pump 45 can be used to execute the ink supply to the first ink tanks 13, the purge for the first discharge head 41, and the purge for the second discharge head 20. Therefore, it is unnecessary to provide individual pumps for the respective processes. It is possible to realize the small size and the low price of each of the main printer 2 and the sub printer 4.

The foregoing explanation has been made for the case in which the inks of all of the colors are discharged in the purge process for the sub printer 4. However, the purge process can be also performed such that the ink or inks of arbitrary color or colors is/are selectively discharged. In this procedure, the second valve 37 is opened so that the ink flow is allowed to flow for only the route which is included in the routes ranging from the first ink tanks 13 via the sub printer 4 to arrive at the waste ink-accommodating section 46 and through which the ink of the color intended to be discharged from the second discharge head 23 by means of the purge process is allowed to flow, and the other second valves 37 and all of the first valves 43 are closed, while the pump 45 is driven to effect the sucking. Accordingly, it is possible to perform the purge process in which only the ink of the desired color is discharged from the second discharge head 23.

In the arrangement shown in FIG. 5, the second discharge head 23 of the sub printer 4 is subjected to the purge process, simultaneously with which the inks are supplied from the first ink tanks 13 of the main printer 2 to the second ink tanks 20 of the sub printer 4. However, when it is aimed that only the purge for the sub printer 4 is simply performed, it is unnecessary that the first ink tanks 13 and the second ink tanks 20 are not communicated with each other via the tubes 36 when the sub printer 4 is installed to the main printer 2. It is also allowable that the second ink tanks 20 may be open to the atmospheric air.

Second Embodiment

Figure 10:
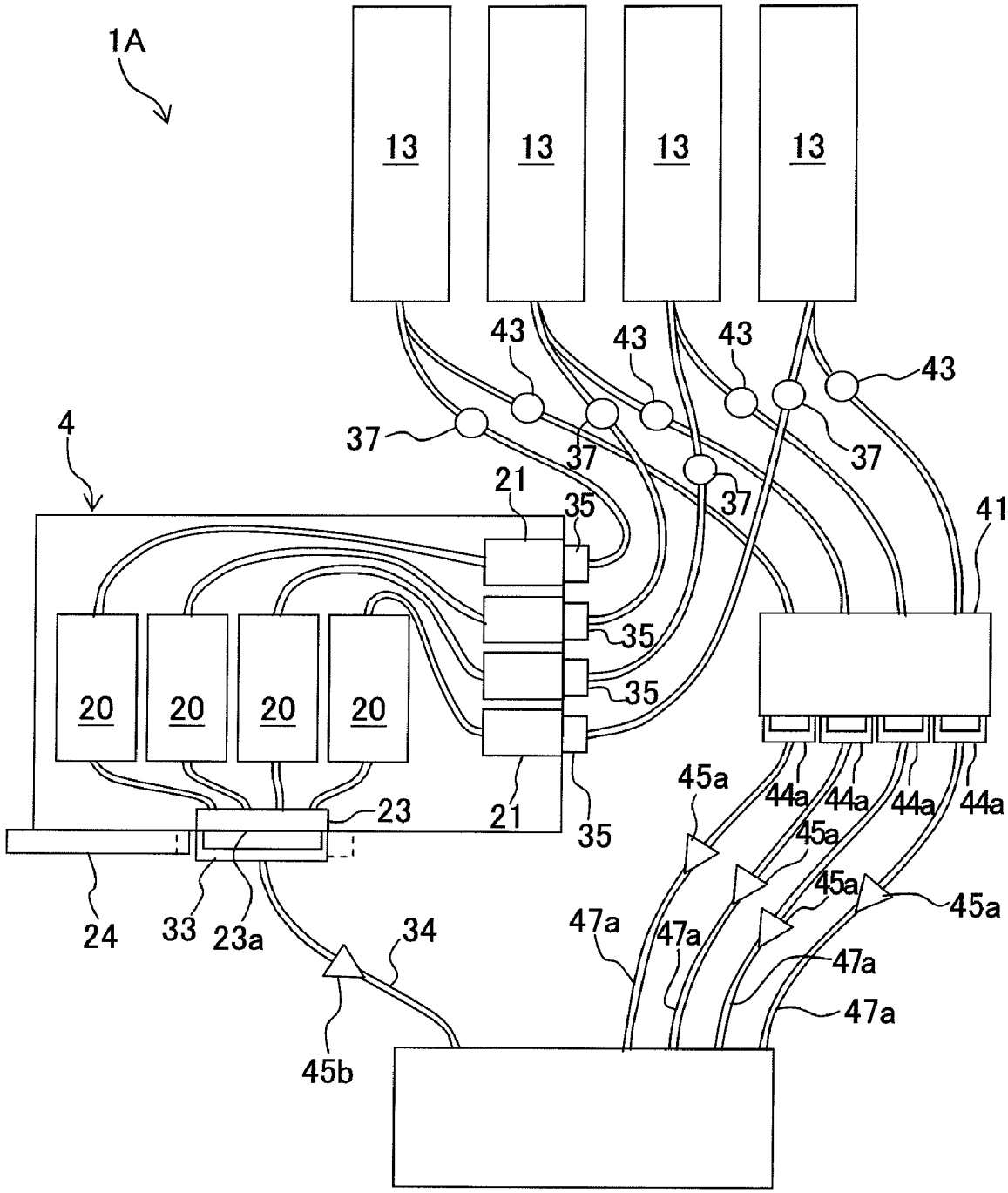
FIG. 10 schematically shows a printer system 1A according to a second embodiment.

FIG. 10 schematically shows a printer system 1A according to this embodiment. The printer system 1A shown in FIG. 10 comprises four first caps 44 which cover the nozzle surface 41*a* of the first discharge head 41 individually for respective colors, four tubes 47*a* which extend from the first caps 44 respectively to the waste ink-accommodating section 46, and pumps 45*a* which are provided at intermediate positions of the tubes 47*a* respectively to suck the internal fluids contained in the tubes 47*a*. Further, an individual pump 45*b* is provided for the tube 34 which extends from the second cap 33. The other parts or components are constructed in the same manner as those of the printer system 1 according to the first embodiment (FIG. 5). Therefore, the corresponding parts or components are designated by the same reference numerals, any explanation of which will be omitted in this embodiment.

In the case of the printer system 1A constructed as described above, the purge process can be executed for the first discharge head 41 for each of the colors. Further, the printer system 1A is provided with the pump 45*b* exclusively used for the ink supply and the purge process for the sub printer 4. Therefore, the pump 45*b* may have any specification suitable for the ink supply and the purge process for the sub printer 4. The ink supply operation for the sub printer 4 by the printer system 1A and the function and the effect thereof are the same as those having been already explained with reference to FIGS. 7 to 9, any explanation of which will be omitted in this embodiment.

Third Embodiment

Figure 11:
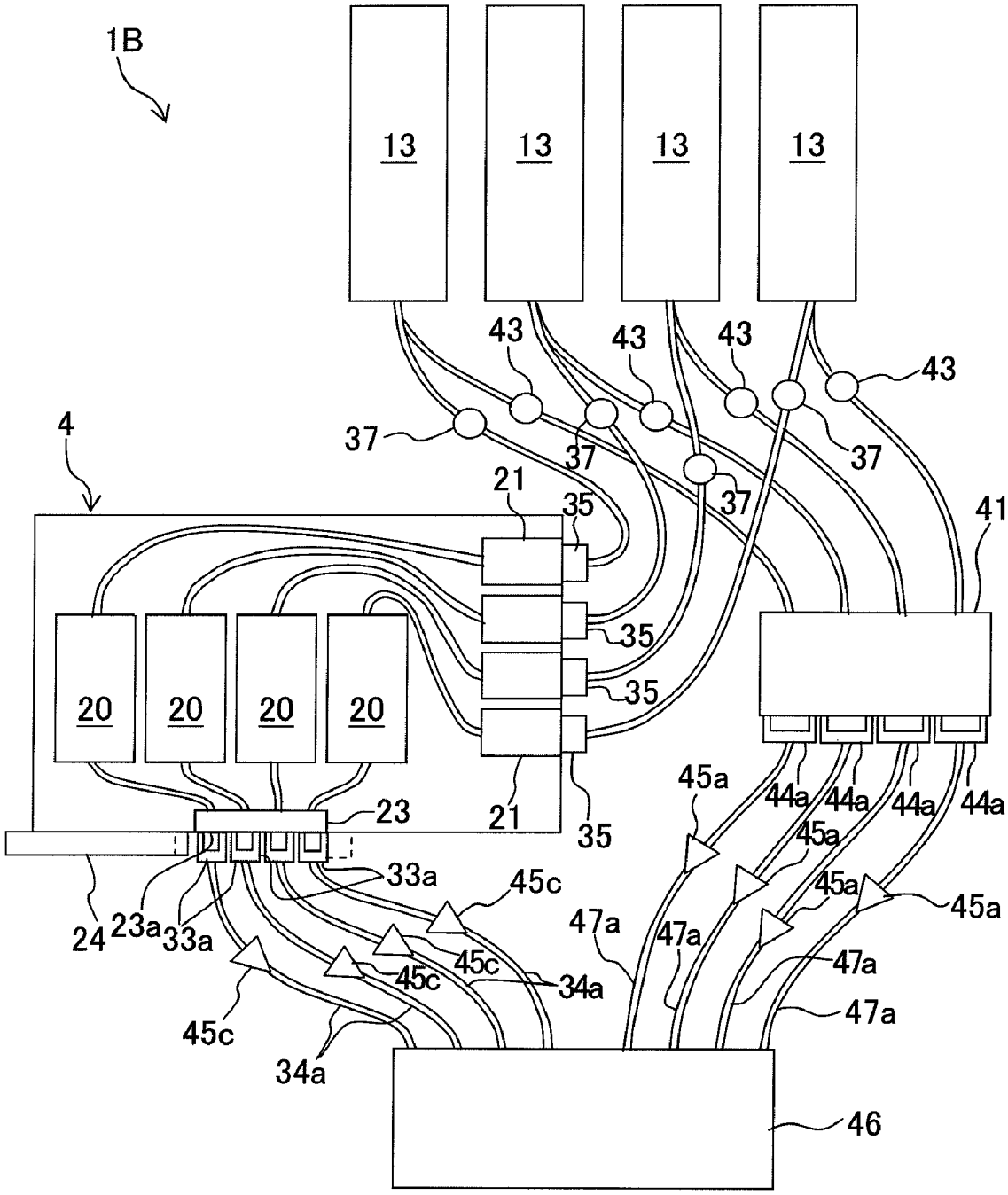
FIG. 11 schematically shows a printer system 1B according to a third embodiment.

FIG. 11 schematically shows a printer system 1B according to a third embodiment. The printer system 1B shown in FIG. 11 is different from the printer system 1A (see FIG. 10) in the form of connection between the sub printer 4 and the waste ink-accommodating section 46. In particular, the printer system 1B includes individual second caps 33*a* which hermetically seal the nozzle surface 23*a* of the second discharge head 23 of the sub printer 4 for the respective colors, tubes 34*a* which extend from the four second caps 33*a* respectively to the waste ink-accommodating section 46, and pumps 45*c* which are arranged at intermediate positions of the tubes 34*a* respectively to suck the internal fluids contained in the tubes 34*a*. The other parts or components are constructed in the same manner as those of the printer system 1A shown in FIG. 10. Therefore, the corresponding parts or components are designated by the same reference numerals, any explanation of which will be omitted in this embodiment.

Regarding the sub printer 4 of the printer system 1B, the purge process can be selectively performed for any arbitrary ink, and any arbitrary ink can be selectively supplied to the second ink tank 20.

When the purge process is performed for the ink of the selected color, it is possible to decrease the number of valves of the first valves 43 and the second valves 37 to be driven. For example, when the purge process is performed for the ink of a certain color, the following procedure is available. That is, only one second valve 37, corresponding to this color, among the four second valve is opened, the four second valves 37 regulating the ink flow between the first ink tanks 13 and the second ink tanks 20. In addition, only one first valve 43, corresponding to this color, among the four first valves 43 is closed, the four first valves regulating the ink flow between the first ink tanks 13 and the first discharge head 41. In this state, the pump 45*c* corresponding to this color is driven to effect the sucking. As described above, it is enough to drive the two valves and the one pump 45*c* which are included in the large number of the provided valves 37, 43 and the large number of the provided pumps 45*c*. The situation is equivalent as well when the ink of the selected color is supplied to the second ink tank 20.

Fourth Embodiment

Figure 12:
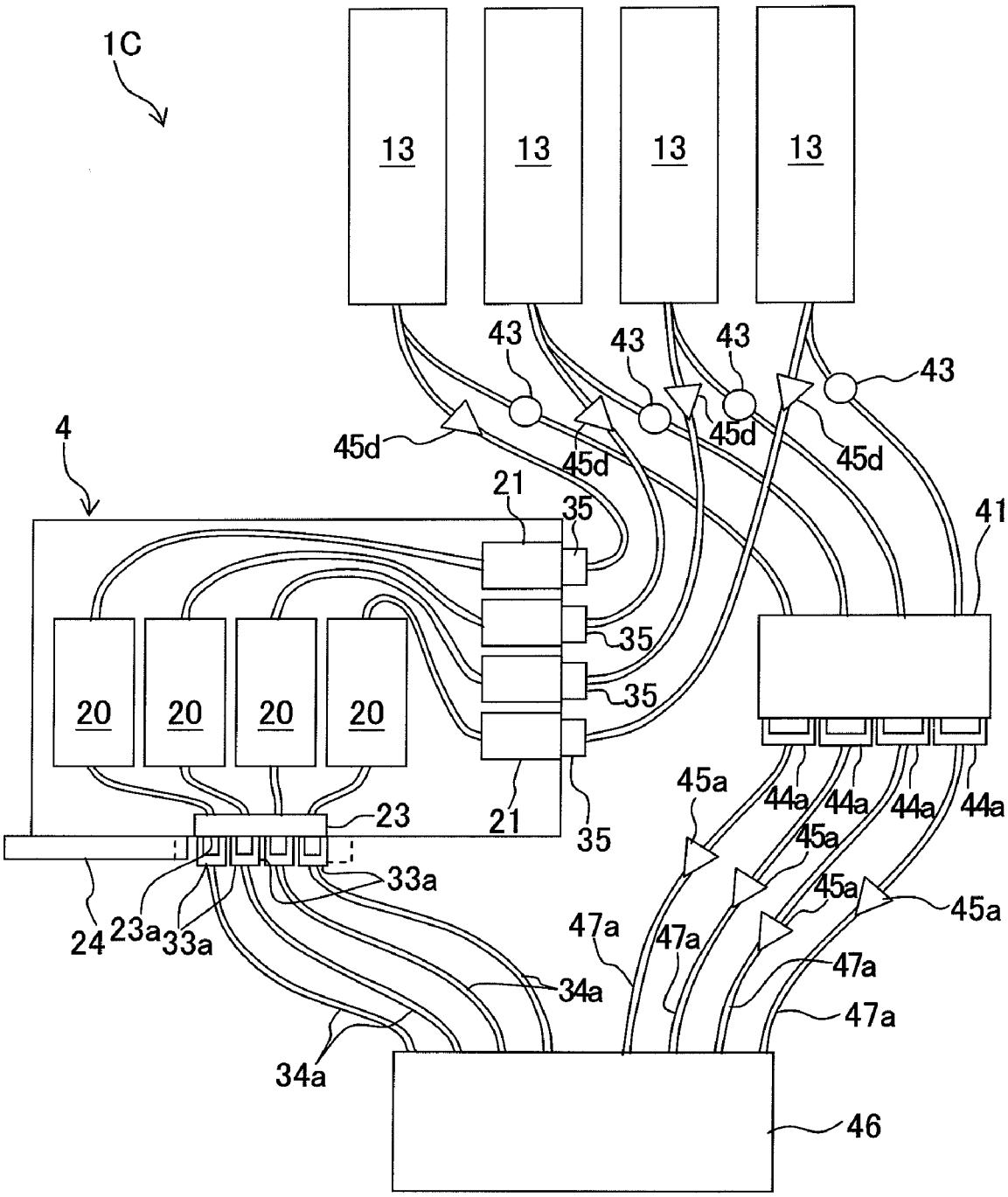
FIG. 12 schematically shows a printer system 1C according to a fourth embodiment.

FIG. 12 schematically shows a printer system 1C according to a fourth embodiment. The printer system 1C shown in FIG. 12 is constructed such that the printer system 1B (see FIG. 11) is modified. Specifically, the printer system 1C is different from the printer system 1B in that the pumps 45*c* provided between the second caps 33 and the waste ink-accommodating section 46 are removed, and pumps 45*d* are provided in place of the second valves 37 provided between the first ink tanks 13 and the second ink tanks 20. The other parts or components are constructed in the same manner as those of the printer system 1B. Therefore, the corresponding parts or components are designated by the same reference numerals, any explanation of which will be omitted in this embodiment.

In the case of the printer system 1C, the second valves 37 provided in the printer systems 1, 1A, 1B are not required in the passages ranging from the first ink tanks 13 via the second ink tanks 20 to arrive at the waste ink-accommodating section 46. In the printer system 1C, the purge process and the ink supply process can be also selectively performed in relation to any arbitrary ink in the same manner as in the printer system 1B. Further, it is possible to decrease the number of the first valves 43 to be driven when these processes are performed.

Fifth Embodiment

Figure 13:
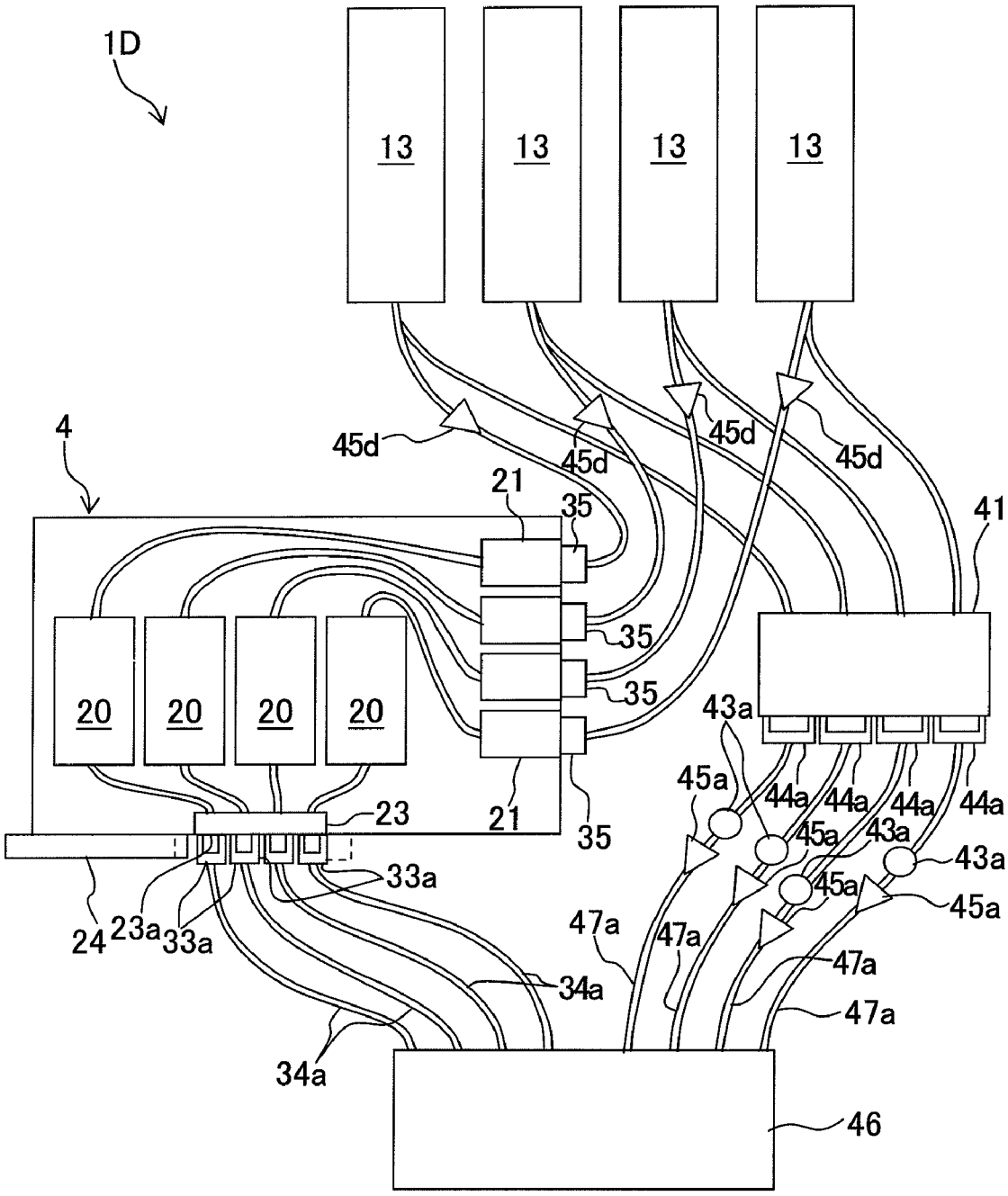
FIG. 13 schematically shows a printer system 1D according to a fifth embodiment.

FIG. 13 schematically shows a printer system 1D according to a fifth embodiment. The printer system 1D is constructed such that the printer system 1C (see FIG. 12) is modified. Specifically, the printer system 1D is different from the printer system 1C in that the first valves 43, which are provided between the first ink tanks 13 and the first discharge head 41, are removed, and first valves 43*a* are provided between the first caps 44*a* and the pump 45*a* at intermediate positions of the tubes 47*a* to make communication between the first caps 44*a* and the waste ink-accommodating section 46. The other parts or components are constructed in the same manner as those of the printer system 1C, any explanation of which will be omitted, while the corresponding parts or components are designated by the same reference numerals.

Even in the case of the printer system 1D, the purge process and the ink supply process can be selectively performed for any arbitrary ink in the same manner as in the printer system 1C. Further, it is possible to decrease the number of the first valve or valves 43 to be driven when such a process is performed.

Sixth Embodiment

Figure 14:
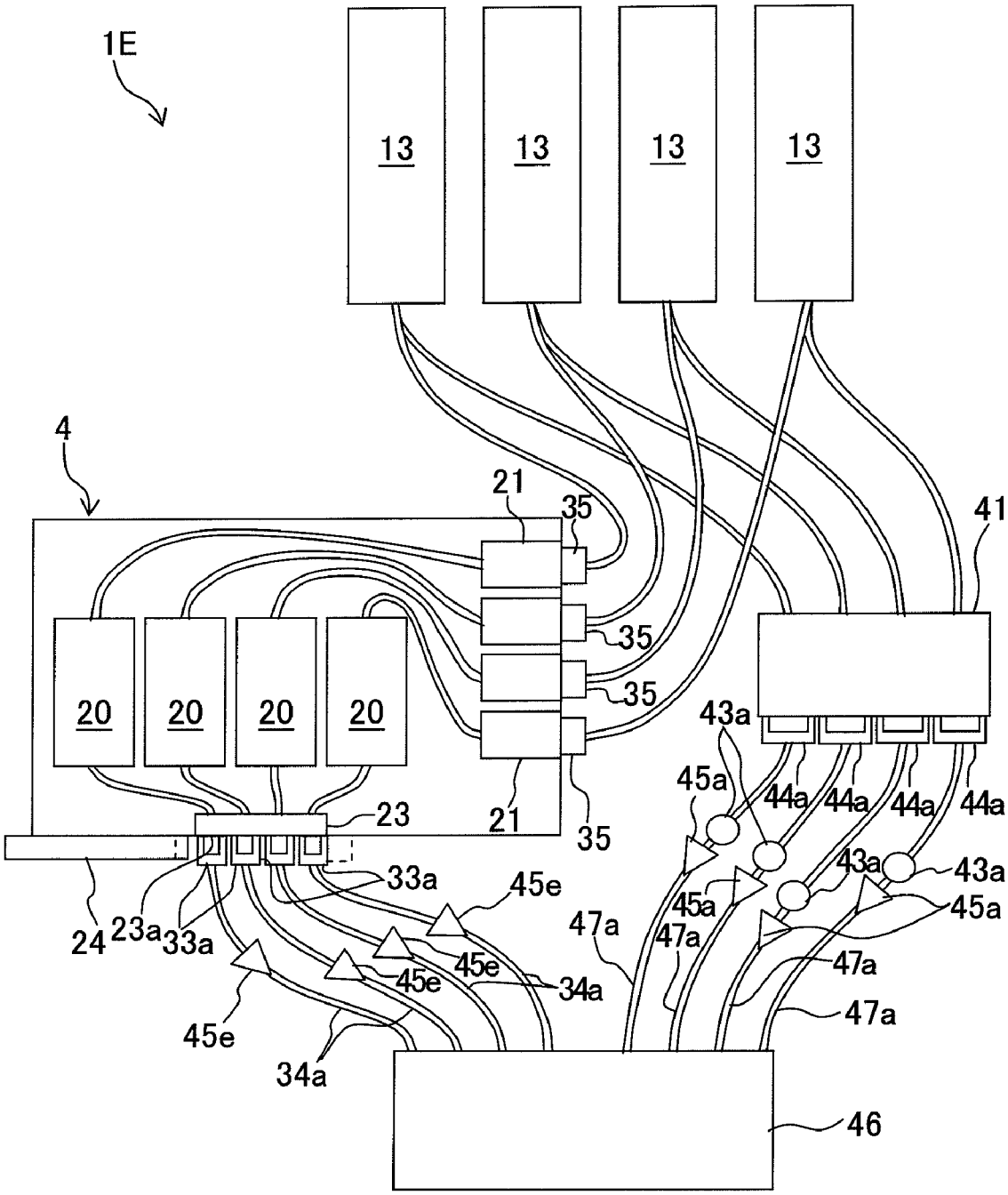
FIG. 14 schematically shows a printer system 1E according to a sixth embodiment.

FIG. 14 schematically shows a printer system 1E according to a sixth embodiment. The printer system 1E is constructed such that the printer system 1D (see FIG. 13) is modified. Specifically, the printer system 1E is different from the printer system 1D in that the pumps 45*d*, which are provided between the first ink tanks 13 and the second ink tanks 20, are removed, and pumps 45*e* are provided at intermediate positions of the tubes 34*a* to make communication between the second caps 33*a* and the waste ink-accommodating section 46. The other parts or components are constructed in the same manner as those shown in FIG. 13 in the fifth embodiment, any explanation of which will be omitted, while the corresponding parts or components are designated by the same reference numerals.

Even in the case of the printer system 1E, the purge process and the ink supply process can be selectively performed for any arbitrary ink in the same manner as in the printer system 1D. Further, it is possible to decrease the number of the first valve or valves 43 to be driven when such a process is performed.

Seventh Embodiment

Figure 15:
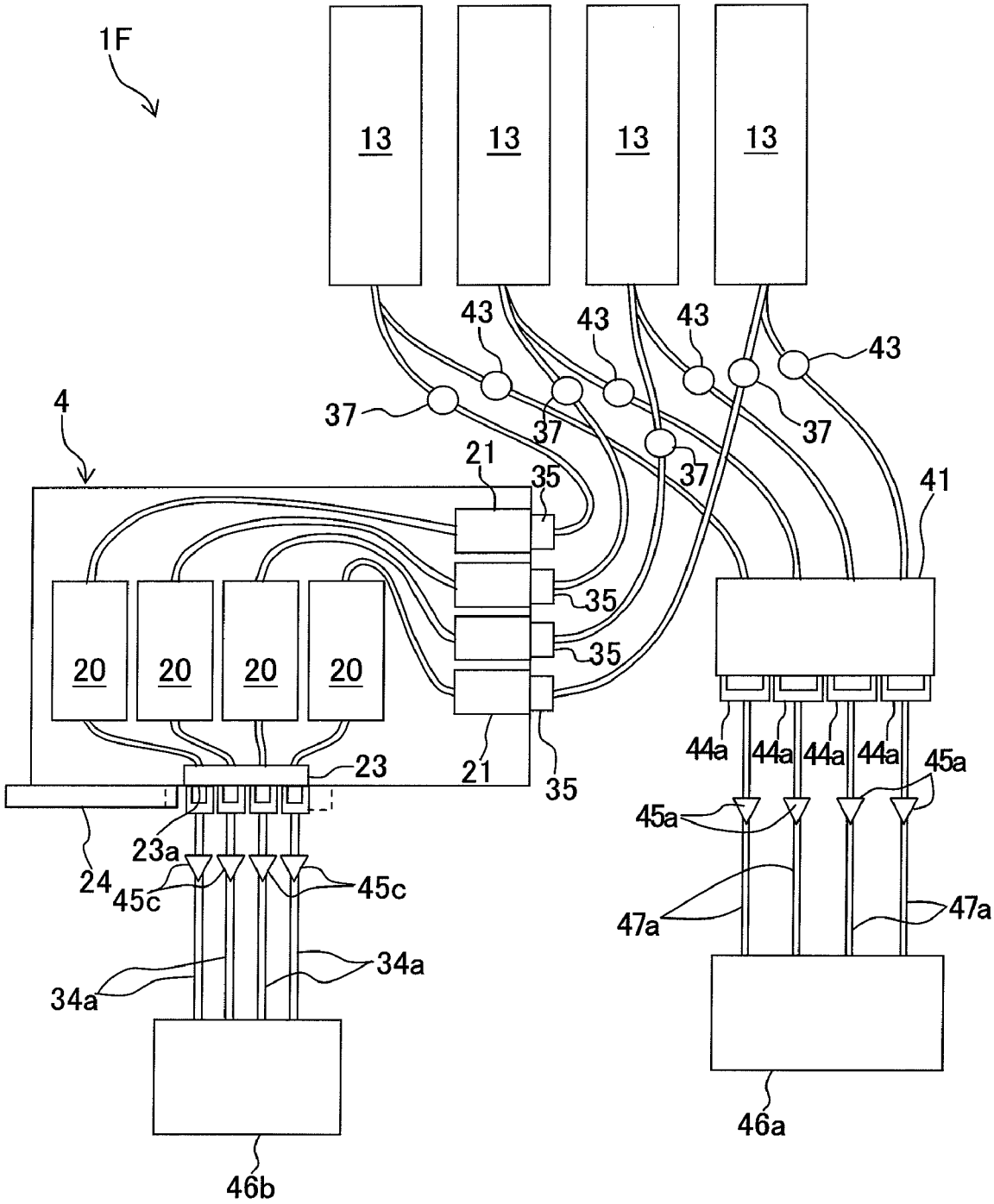
FIG. 15 schematically shows a printer system 1F according to a seventh embodiment.

FIG. 15 schematically shows a printer system 1F according to a seventh embodiment. The printer system 1F is constructed such that the printer system 1B (see FIG. 11) is modified. Specifically, the printer system 1F is different from the printer system 1B in that two waste ink-accommodating sections 46*a*, 46*b* are provided in place of one waste ink-accommodating section 46 provided for the main printer 2. In the printer system 1F, one waste ink-accommodating section 46*a* accommodates the waste inks discharged from the first discharge head 41 of the main printer 2, and the other waste ink-accommodating section 46*b* accommodates the waste inks discharged from the second discharge head 23 of the sub printer 4.

Even in the case of the printer system 1F, the purge process can be selectively performed for any arbitrary ink in relation to the sub printer in the same manner as in the printer system 1B. It is possible to selectively supply any arbitrary ink to the second tank. Further, it is possible to decrease the number of the first valve or valves 43 and second valve or valves 37 to be driven when the purge process is performed for the ink of the selected color. Further, the two waste ink-accommodating sections 46*a*, 46*b* are provided corresponding to the main printer 2 and the sub printer 4. Therefore, they can be constructed corresponding to the ways of use thereof respectively, and it is possible to optimize the layout.

Eighth Embodiment

Figure 16:
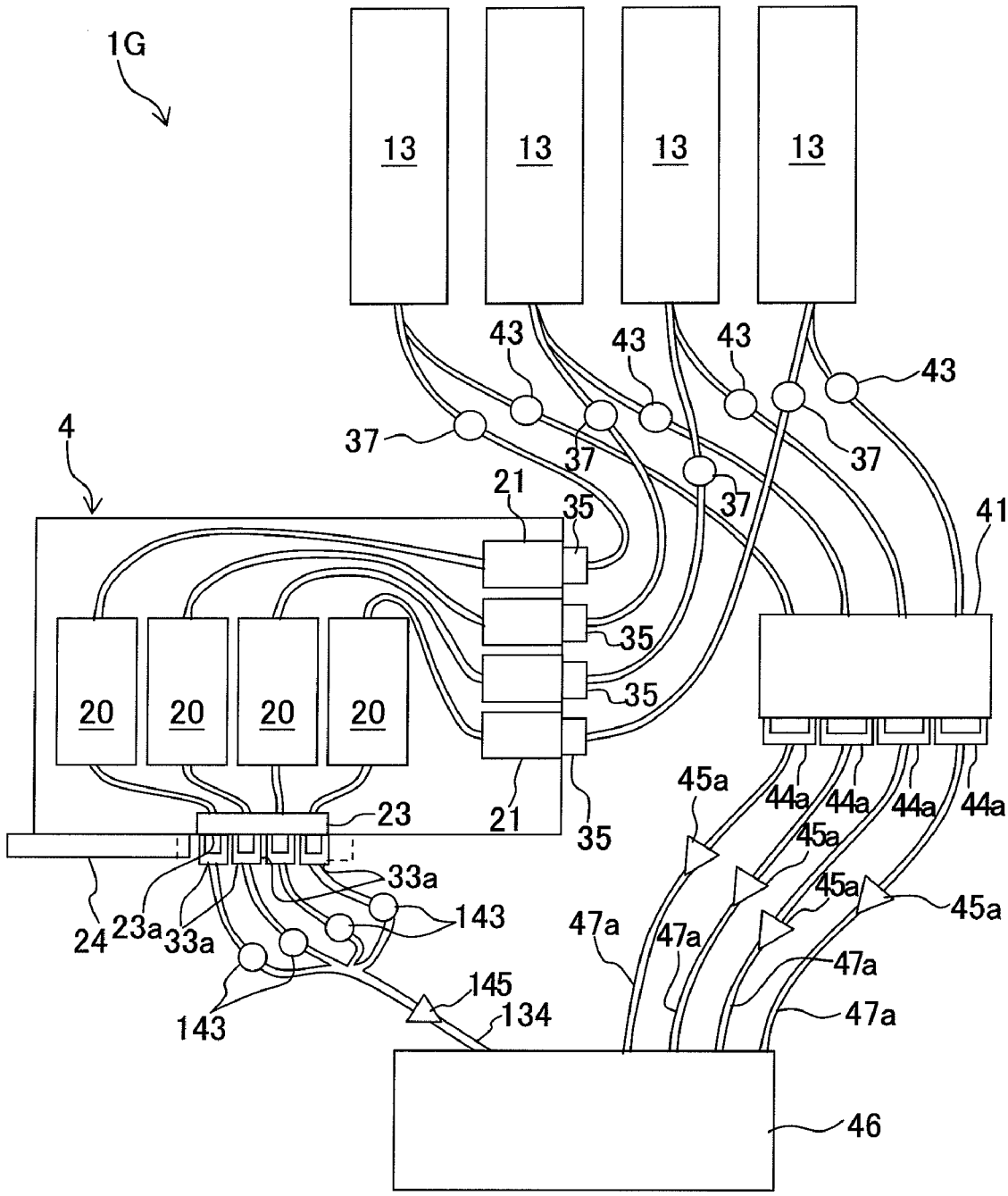
FIG. 16 schematically shows a printer system 1G according to a eighth embodiment.

FIG. 16 schematically shows a printer system 1G according to an eighth embodiment. The printer system 1G shown in FIG. 16 is different from the printer system 1B shown in FIG. 11 in that valves 143 are provided in place of the pumps 45*c* at intermediate positions of the tubes 34*a* allowed to extend from the second caps 33*a*, the tubes 34*a* merge into one tube 134 at the downstream of the valves 143, and a pump 145 for sucking the fluid is provided in the tube 134. Even in the case of the printer system 1G, the inks of the respective colors can be selectively supplied to the second ink tanks 20 of the sub printer 4, and the second head 23 of the sub printer 4 can be selectively purged for the respective colors, in the same manner as in the printer system 1B. Further, it is possible to decrease the number of the pump or pumps required to supply the inks and purge the head. As for the main printer, it is also allowable in the same manner as the above that valves are provided in place of the pumps 45*a* at intermediate positions of the tubes 47*a* allowed to extend from the first cap 44*a*, the tubes 47*a* are allowed to merge into one tube at the downstream, and a pump is provided for the merged tube.

As exemplified above in the first to eighth embodiments, the printer systems 1, 1A to 1G according to the embodiments of the present invention are capable of performing the purge process for the sub printer 4 by installing the sub printer 4 to the main printer 2 having the printer function. That is, the main printer 2 is capable of forming the image on the recording paper by discharging the inks from the first discharge head, because the main printer 2 has the printer function. Further, the main printer 2 is also capable of performing the purge process for the sub printer 4. The main printer 2 is provided with both of the printer function and the purge process function for the sub printer 4. Therefore, it is unnecessary to prepare any exclusive station specialized to the ink supply in order to supply the inks to the sub printer 4.

In this arrangement, the waste ink-accommodating sections 46, 46*a*, 46*b* and the pumps 45, 45*a* to 45*e* are carried on the main printer 2. Therefore, it is possible to miniaturize the sub printer 4, or it is possible to effectively utilize the space in the casing 5 of the sub printer 4 in order to realize the large volumes of the second ink tanks 20.

The pumps 45, 45*a* to 45*e* are provided at the intermediate positions of the respective tubes. However, the pumps 45, 45*a* to 45*e* are capable of being arranged at arbitrary positions on the tubes. For example, the pumps 45, 45*a* to 45*e* may be provided at the ends of the respective tubes. When the first ink tank 13 of the main printer 2 is provided with any pressurizing pump, it is not necessarily indispensable that the sucking pumps 45, 45*a* to 45*e* are provided. The pressurizing pump may be operated in place of the sucking pump in operations S4, S15, S24, and S25 shown in FIGS. 7 to 9.

The main printer is not necessarily the multifunction machine having, for example, the scan function. The main printer may have only the printer function. The number and the type of the ink or inks of each of the main printer and the sub printer may be arbitrary. For example, the main printer may be a full color printer for discharging the four color inks of black, cyan, magenta, and yellow, and the sub printer may be a monochrome or black and white printer for discharging only the black ink. In this case, only the black ink is supplied when the sub printer is installed to the main printer. The sub printer may be of the charging type. For example, the sub printer may be charged by receiving the supply of the electric power from the main printer during the period in which the sub printer is installed to the main printer. However, there is no limitation thereto.

As described above, the present invention makes it possible to realize the large volume of the ink tank, because any waste ink-accommodating section is not provided in the portable type printer. Further, the present invention is applicable to the printer system for which it is unnecessary to provide any exclusive station.

What is claimed is:

1. A printer system which performs printing by discharging an ink onto a recording medium, the printer system comprising:

a main printer having a first head which discharges the ink onto the recording medium and a waste-ink tank which stores a waste ink;

a portable type sub printer having a second head which discharges the ink onto the recording medium independently from the main printer, the sub printer being detachable with respect to the main printer;

a position detecting section; and a controller configured to control the ink discharge from the second head according to a position of the sub printer on the recording medium detected by the position detecting section, wherein:

the waste-ink tank accommodates the waste ink discharged from the second head of the sub printer when the sub printer is installed to the main printer.

2. The printer system according to claim 1, wherein the waste ink tank also stores a waste ink discharged from the first head of the main printer.

3. The printer system according to claim 1, wherein the main printer further includes a pump by which the waste ink is discharged from the second head when the sub printer is installed to the main printer.

4. The printer system according to claim 3, wherein the waste ink from the first head of the main printer is also discharged by the pump.

5. The printer system according to claim 1, wherein the controller controls the main printer and the sub printer, so that the controller allows the second head of the sub printer to discharge the waste ink when the sub printer is installed to the main printer.

6. The printer system according to claim 5, wherein the main printer further includes an installing section to which the sub printer is detachably installed, a cap for the second head which hermetically seals an ink-discharge surface of the second head, through which the ink is discharged, when the sub printer is installed to the installing section, and a communication passage which makes communication between the cap for the second head and the waste ink tank.

7. The printer system according to claim 6, wherein the main printer includes a cap for the first head which hermetically seals an ink-discharge surface of the first head, through which the ink is discharged, and a communication passage which makes communication between the cap for the first head and the waste ink tank.

8. The printer system according to claim 1, wherein the controller controls the main printer and the sub printer and an input device which inputs a predetermined instruction into the controller, so that the controller allows the second head of the sub printer to discharge the waste ink when the sub printer is installed to the main printer and the predetermined instruction is inputted into the input device.

9. The printer system according to claim 8, wherein the main printer further includes an installing section to which the sub printer is detachably installed, a cap for the second head which hermetically seals an ink-discharge surface of the second head, through which the ink is discharged, when the sub printer is installed to the installing section, and a communication passage which makes communication between the cap for the second head and the waste ink tank.

10. The printer system according to claim 9, wherein the main printer includes a cap for the first head which hermetically seals an ink-discharge surface of the first head, through which the ink is discharged, and a communication passage which makes communication between the cap for the first head and the waste ink tank.

11. The printer system according to claim 1, wherein the controller controls the main printer and the sub printer;

the main printer has a first tank which stores the ink, and the sub printer has a second tank which stores the ink and which has a volume smaller than that of the first tank; and the first tank communicates with the second tank so as to supply the ink from the first tank to the second tank when the sub printer is installed to the main printer.

12. The printer system according to claim 11, wherein the controller controls the main printer and the sub printer, such that the waste ink is discharged from the second head of the sub printer after supplying the ink from the first tank to the second tank.

13. The printer system according to claim 11, wherein:

the main printer includes a first regulating section which regulates a flow of the ink between the first tank and the first head; and the controller allows the waste ink to be discharged from the second head of the sub printer in a state in which the flow of the ink is regulated by the first regulating section between the first tank and the first head.

14. The printer system according to claim 11, wherein:

the main printer includes a second regulating section which regulates a flow of the ink between the first tank and the second tank; and the controller allows the ink to be supplied from the first tank to the first head in a state in which the flow of the ink is regulated by the second regulating section between the first tank and the second tank.

15. The printer system according to claim 1, wherein the main printer further comprises a detecting mechanism which detects that the sub printer is installed to the main printer.

16. The main printer of the print system according to claim 1 further comprising:

a sub printer-installing section to which the sub printer is detachably installed, wherein the waste ink tank stores a waste ink discharged from the second head when the sub printer is installed to the main printer.

17. The main printer according to claim 16, wherein the waste ink tank also stores a waste ink discharged from the first head.

18. The main printer according to claim 16, further comprising a pump by which the waste ink is discharged from the second head when the sub printer is installed to the main printer.

19. The main printer according to claim 18, wherein the waste ink from the first head of the main printer is also discharged by the pump.

20. The main printer according to claim 16, wherein:

the main printer further includes the controller which controls the main printer and the sub printer, a first tank which stores the ink, and a first regulating section which regulates a flow of the ink between the first tank and the first head; and the controller allows the waste ink to be discharged from the second head of the sub printer in a state in which the flow of the ink is regulated by the first regulating section between the first tank and the first head.

21. The main printer according to claim 20, further comprising a second regulating section which regulates flow of the ink between the first tank and a second tank possessed by the sub printer, wherein:

the controller allows the ink to be supplied from the first tank to the first head in a state in which the flow of the ink is regulated by the second regulating section between the first tank and the second tank.

22. The printer system according to claim 1, wherein the sub printer is configured to discharge the ink onto the recording medium during a manual scanning process.

23. A method for discharging a waste ink from a printer system, the printer system comprising:

a main printer having a first head which discharges an ink onto a recording medium, a first tank which stores the ink, a first valve which regulates a flow of the ink between the first tank and the first head, and a waste ink tank which stores the waste ink; a portable type sub printer having a second head which discharges the ink onto the recording medium independently from the main printer, and a second valve which regulates a flow of the ink between the first tank and the second tank, the sub printer being detachable with respect to the main printer; a position detecting section; and a controller configured to control the ink discharge from the second head according to a position of the sub printer on the recording medium detected by the position detecting section, wherein the waste ink tank stores the waste ink discharged from the second head of the sub printer installed to the main printer, and the method comprising:

detecting installation of the sub printer;

closing the first valve and opening the second valve when the installation of the sub printer is detected; and discharging the waste ink from the second head.

24. The method for discharging the waste ink according to claim 23, further comprising supplying the ink from the first tank to the second tank before discharging the waste ink from the second head.

25. A method for discharging a waste ink from a printer system, the printer system comprising:

a main printer having a first head which discharges an ink onto a recording medium, a first tank which stores the ink, a first valve which regulates a flow of the ink between the first tank and the first head, and a waste ink tank which stores the waste ink; a portable type sub printer having a second head which discharges the ink onto a recording medium independently from the main printer, and a second valve which regulates a flow of the ink between the first tank and the second tank, the sub printer being detachable with respect to the main printer; and an input device which inputs a predetermined instruction, a position detecting sectioff, and a controller configured to control the ink discharge from the second head according to a position of the sub printer on the recording medium detected by the position detecting section, wherein the waste ink tank stores the waste ink discharged from the second head of the sub printer installed to the main printer, and the method comprising:

detecting installation of the sub printer;

closing the first valve and opening the second valve when the installation of the sub printer is detected and the predetermined instruction is inputted from the input device; and discharging the waste ink from the second head.

* * * * *